US009745084B2

(12) United States Patent
Nakamura et al.

(10) Patent No.: US 9,745,084 B2
(45) Date of Patent: Aug. 29, 2017

(54) LIQUID MEDICATION DISPENSING MACHINE

(75) Inventors: Akihiro Nakamura, Hirakata (JP); Tetsuya Miyagi, Hirakata (JP)

(73) Assignee: TAKAZONO TECHNOLOGY INCORPORATED, Hirakata-shi (JP)

( * ) Notice: Subject to any disclaimer, the term of this patent is extended or adjusted under 35 U.S.C. 154(b) by 242 days.

(21) Appl. No.: 14/351,993

(22) PCT Filed: Sep. 7, 2012

(86) PCT No.: PCT/JP2012/072886

§ 371 (c)(1),
(2), (4) Date: Apr. 15, 2014

(87) PCT Pub. No.: WO2013/061696

PCT Pub. Date: May 2, 2013

(65) Prior Publication Data

US 2014/0261880 A1 Sep. 18, 2014

(30) Foreign Application Priority Data

Oct. 28, 2011 (JP) ..... 2011-237314
Dec. 27, 2011 (JP) ..... 2011-285982
Dec. 27, 2011 (JP) ..... 2011-285985

(51) Int. Cl.
*B65B 3/04* (2006.01)
*B65B 3/00* (2006.01)
(Continued)

(52) U.S. Cl.
CPC ..... *B65B 3/003* (2013.01); *G07F 13/00* (2013.01); *G07F 17/0092* (2013.01); *B65B 2210/08* (2013.01)

(58) Field of Classification Search
CPC .. B65B 3/003; B65B 2210/06; B65B 2210/08
(Continued)

(56) References Cited

U.S. PATENT DOCUMENTS 4,559,961 A * 12/1985 Anderson ..... B67C 3/001 134/166 R
4,898,327 A * 2/1990 Sperry ..... B05B 7/0025 134/166 R
(Continued)

FOREIGN PATENT DOCUMENTS

JP 43-11834 Y1 5/1968
JP 44-030675 B1 12/1969
(Continued)

OTHER PUBLICATIONS

Machine translation of JP2008119024, May 2008, all pages.*
(Continued)

*Primary Examiner* — Nicolas A Arnett
(74) *Attorney, Agent, or Firm* — Westerman, Hattori, Daniels & Adrian, LLP

(57) ABSTRACT

Provided is a liquid medication dispensing machine that can remove a liquid medication from one end of a supply pipe with higher reliability. The liquid medication dispensing machine includes a plurality of supply nozzles located at equal intervals through which liquid medications flow from a plurality of liquid medication bottles containing the liquid medications, respectively, to a prescription bottle. The plurality of supply nozzles are moved sequentially to a supply position where a supply nozzle faces an upper opening of the prescription bottle. The liquid medication dispensing machine further includes a cleaning unit that removes the liquid medication adhering to the supply nozzle. The supply nozzles are moved sequentially to a cleaning position where the cleaning unit removes the liquid medication from the supply nozzle. The cleaning position is provided at a position away from the supply position by a distance smaller than a spacing between the supply nozzles.

12 Claims, 18 Drawing Sheets

(51) Int. Cl.
*G07F 13/00* (2006.01)
*G07F 17/00* (2006.01)

(58) Field of Classification Search
USPC ..... 141/9, 85, 89–91, 100, 104
See application file for complete search history.

(56) References Cited

U.S. PATENT DOCUMENTS 5,293,911 A * 3/1994 Akeel ..... B05B 5/1625 118/302
6,761,191 B2 * 7/2004 Rosen ..... B67C 3/001 134/168 C
6,827,113 B2 * 12/2004 Downs ..... B01F 13/1055 141/1
7,610,115 B2 * 10/2009 Rob ..... A61J 1/20 318/568.11
7,783,383 B2 * 8/2010 Eliuk ..... A61J 1/20 141/1
7,931,859 B2 * 4/2011 Mlodzinski ..... A61J 1/20 221/123
8,386,070 B2 * 2/2013 Eliuk ..... A61J 1/20 141/1
8,757,225 B2 * 6/2014 Knieling ..... B67C 3/02 141/104
2002/0139436 A1 10/2002 Rosen et al.
2006/0259195 A1 * 11/2006 Eliuk ..... A61J 1/20 700/245
2007/0144610 A1 * 6/2007 Berger ..... B65B 39/00 141/286
2010/0198392 A1 * 8/2010 Eliuk ..... A61J 1/20 700/216
2016/0009533 A1 * 1/2016 Clusserath ..... B67C 3/002 141/91

FOREIGN PATENT DOCUMENTS

JP 2007-021087 A 2/2007
JP 2007-320620 A 12/2007
JP 2008-119024 A 5/2008
JP 2008-119027 A 5/2008
JP 2009-504199 A 2/2009
JP 2009-142381 A 7/2009
WO 2006/124211 A2 11/2006
WO 2010/110303 A1 9/2010
WO 2011/118835 A1 9/2011

OTHER PUBLICATIONS

European Search Report dated Jul. 3, 2015, isused in counterpart application No. 12843261.4 (7 pages).
International Search Report for PCT/JP2012/072886, Mailing Date of Nov. 20, 2012.
Office Action dated Mar. 15, 2016, issued in counterpart Japanese Patent Application No. 2011-285985, with English translation. (7 pages).
Decision to Grant a Patent dated Mar. 22, 2016, issued in counterpart Japanese Patent Application No. 2011-285982, with English translation. (6 pages).
Office Action dated Mar. 24, 2017, issued in counterpart European application No. 12 843 261.4. (5 pages).

* cited by examiner

| | |
|---|---|
| AT THE STARTUP | CLEANING IS PERFORMED |
| AT THE START OF DISPENSING | CLEANING IS PERFORMED |
| AT THE COMPLETION OF DISPENSING | CLEANING IS PERFORMED |

| | |
|---|---|
| NOZZLE CLEANING INQUIRY INTERVAL | T1 |
| NOZZLE CLEANING INTERVAL | T2 |

LIQUID MEDICATION DISPENSING MACHINE

TECHNICAL FIELD

The present invention relates to a liquid medication dispensing machine, and more particularly relates to a liquid medication dispensing machine for supplying a liquid medication from a liquid medication bottle containing the liquid medication to a prescription bottle.

BACKGROUND ART

Conventionally, a liquid medication as a liquid state medicine is dispensed in a dispensing pharmacy or the like. In accordance with a prescription for a patient, one or a plurality of types of liquid medications are infused sequentially by a predetermined amount into a prescription bottle, and a required diluent is infused, thereby dispensing a liquid medication.

A conventional technique related to a liquid medication dispensing machine for dispensing a liquid medication is disclosed in Japanese Patent Laying-Open No. 2009-142381 (Patent Document 1), for example. The above document proposes a liquid medication dispensing machine wherein the position of a discharge port part of a supply pipe at which a liquid medication is discharged to a prescription bottle is set higher than the liquid level of the liquid medication in a liquid medication bottle, thereby preventing the liquid medication from dropping down from the supply pipe.

CITATION LIST

Patent Document

PTD 1: Japanese Patent Laying-Open No. 2009-142381

SUMMARY OF INVENTION

Technical Problem

In the liquid medication dispensing machine disclosed in the above-mentioned document, the liquid medication present in the supply pipe when driving of a feed pump is stopped is prevented from dropping down from the discharge port part of the supply pipe with gravity by the position setting of the discharge port part at which the liquid medication is discharged to the prescription bottle. However, application of this technique is insufficient for preventing dropping of the liquid medication from the supply pipe. Accordingly, problems still exist in that, for example: an unnecessary liquid medication drops down from the supply pipe to cause dirt on the machine; it is difficult to supply an exact amount of a liquid medication to a prescription bottle under the influence of the dropped liquid medication; the dropped liquid medication exerts an adverse effect on the operation of the machine; the liquid medication dropped from the supply pipe falls into the prescription bottle to cause contamination of the liquid medication in the prescription bottle.

The present invention was made in view of the above-described problems, and has a main object to provide a liquid medication dispensing machine that can prevent dropping of a liquid medication from a supply pipe with higher reliability.

Solution to Problem

A liquid medication dispensing machine according to an aspect of the present invention is a liquid medication dispensing machine selectively supplying a plurality of different types of liquid medications from a plurality of liquid medication bottles containing the liquid medications, respectively, to a prescription bottle, including a plurality of supply pipes through which the liquid medication flows from each of the plurality of the liquid medication bottles toward the prescription bottle, and a supply pipe moving unit that relatively moves the supply pipes with respect to the prescription bottle. The supply pipes each include one end at which the liquid medication flows toward the prescription bottle. A plurality of the one ends are arranged at regular intervals. The supply pipe moving unit sequentially moves the plurality of the supply pipes to a supply position where the one end faces an upper opening of the prescription bottle above the upper opening. The liquid medication dispensing machine further includes a cleaning unit that removes the liquid medication adhering to the one end from the one end. The supply pipe moving unit sequentially moves the plurality of the supply pipes to a cleaning position where the cleaning unit removes the liquid medication from the one end. The cleaning position is provided at a position away from the supply position by a distance smaller than a spacing between the one ends.

The above liquid medication dispensing machine preferably includes a sensor that detects adhesion of the liquid medication to the one end. When the sensor detects adhesion of the liquid medication to the one end, the supply pipe moving unit moves the supply pipe to the cleaning position. The sensor may be a sensor that detects the position of the prescription bottle.

In the above liquid medication dispensing machine, preferably, the cleaning unit can remove the liquid medication from the one end at a plurality of the cleaning positions, and the cleaning positions are provided respectively at positions away from the supply position to opposite sides from the supply position by a distance smaller than the spacing between the one ends.

In the above liquid medication dispensing machine, preferably, the cleaning positions are provided at positions away from the supply position by a half distance of the spacing between the one ends.

In the above liquid medication dispensing machine, preferably, the supply pipe moving unit moves the supply pipes to the cleaning position at a predetermined time interval during a dispensing stop period during which dispensing of supplying the liquid medication from the liquid medication bottle to the prescription bottle in accordance with a prescription is not performed. The predetermined time interval may be set in correspondence to the type of the liquid medication contained in the liquid medication bottle.

A liquid medication dispensing machine according to another aspect of the present invention is a liquid medication dispensing machine selectively supplying a plurality of different types of liquid medications from a plurality of liquid medication bottles containing the liquid medications, respectively, to a prescription bottle, including a plurality of supply pipes through which the liquid medication flows from each of the plurality of the liquid medication bottles toward the prescription bottle, and a supply pipe moving unit that relatively moves the supply pipes with respect to the prescription bottle. The supply pipes each include one end at which the liquid medication flows toward the prescription bottle. The supply pipe moving unit sequentially moves the plurality of the supply pipes to a supply position where the one end faces an upper opening of the prescription bottle above the upper opening. The liquid medication dispensing machine further includes a cleaning unit that removes the liquid medication adhering to the one end from the one end, and a control unit that controls operation of the liquid medication dispensing machine. The control unit supplies the liquid medication from the liquid medication bottle to the prescription bottle in accordance with a prescription to perform dispensing, and operates the cleaning unit at a predetermined time interval during a dispensing stop period during which dispensing is not performed.

In the above liquid medication dispensing machine, preferably, the predetermined time interval is set in correspondence to the type of the liquid medication contained in the liquid medication bottle.

In the above liquid medication dispensing machine, preferably, the control unit operates the cleaning unit at the completion of dispensing.

In the above liquid medication dispensing machine, preferably, the control unit operates the cleaning unit at the start of dispensing.

Advantageous Effects of Invention

According to the liquid medication dispensing machine of the present invention, dropping of a liquid medication from a supply pipe can be prevented with higher reliability.

DESCRIPTION OF EMBODIMENTS

Figure 1:
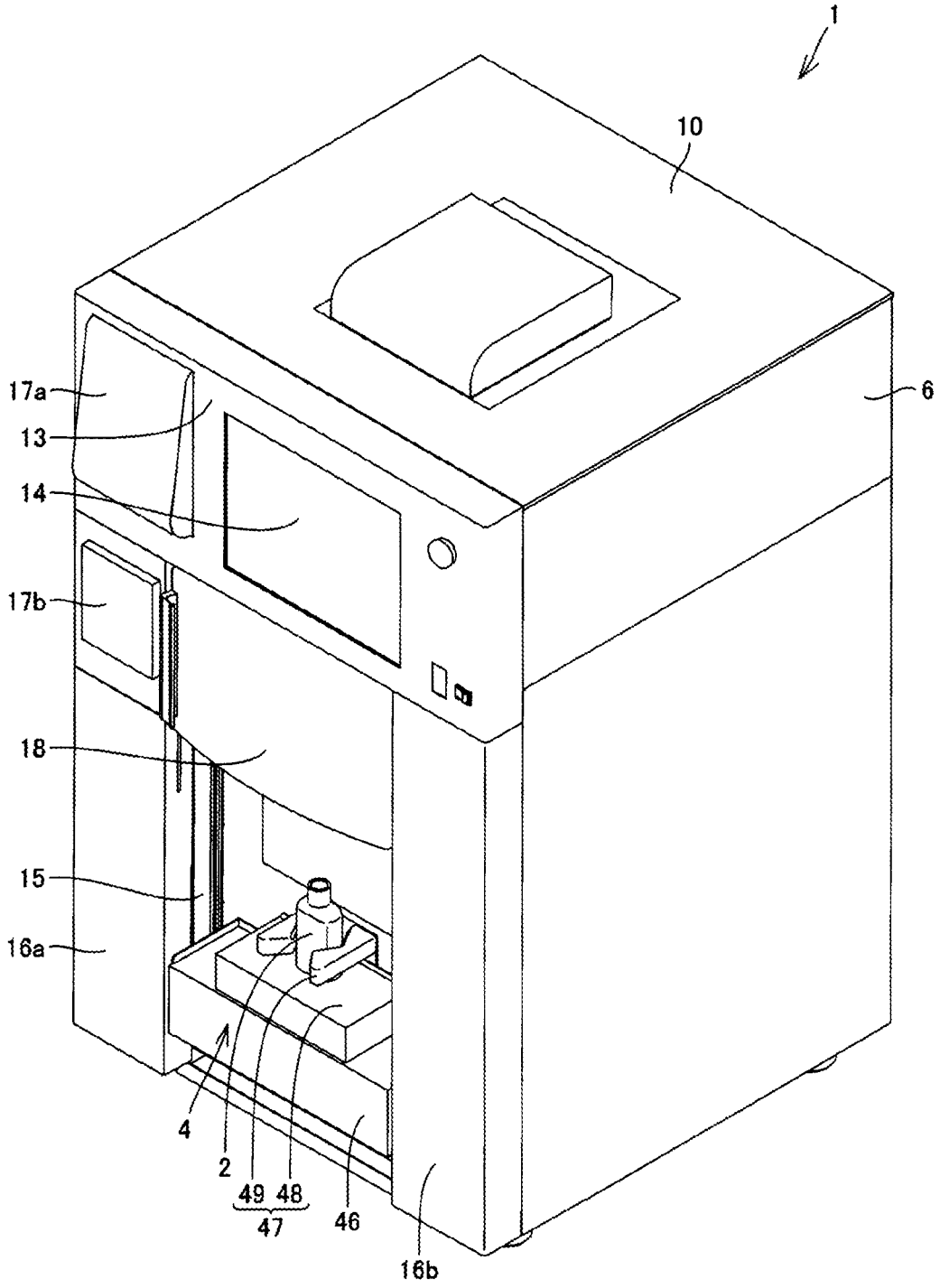
FIG. 1 is a perspective view showing a structure of a liquid medication dispensing machine of one embodiment of the present invention.

Embodiments of the present invention will be described below based on the drawings. In the following drawings, the same or corresponding portions have the same reference characters allotted, and description thereof will not be repeated.

First Embodiment

Figure 2:
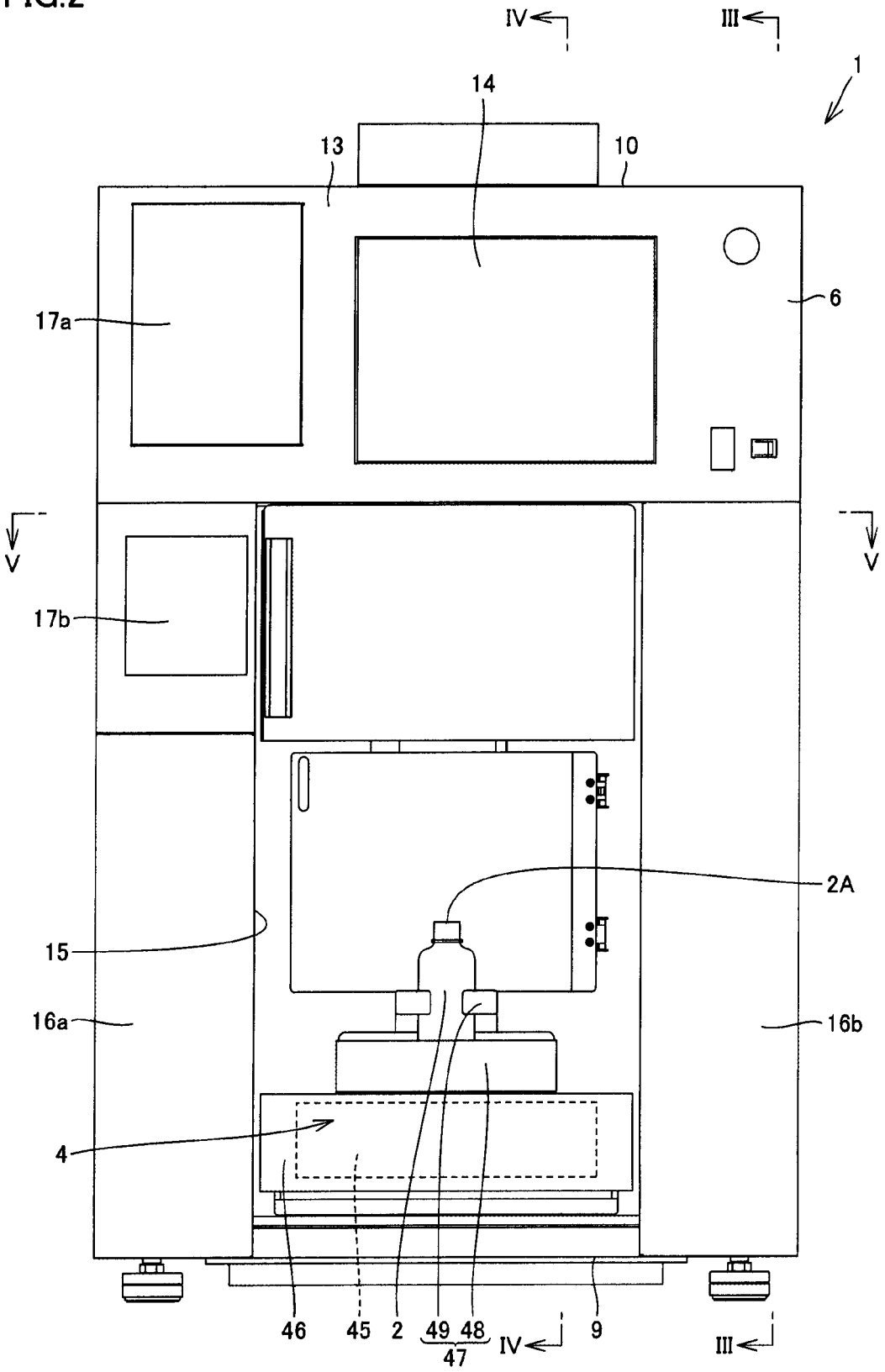
FIG. 2 is a front view of the liquid medication dispensing machine shown in FIG. 1.
Figure 3:
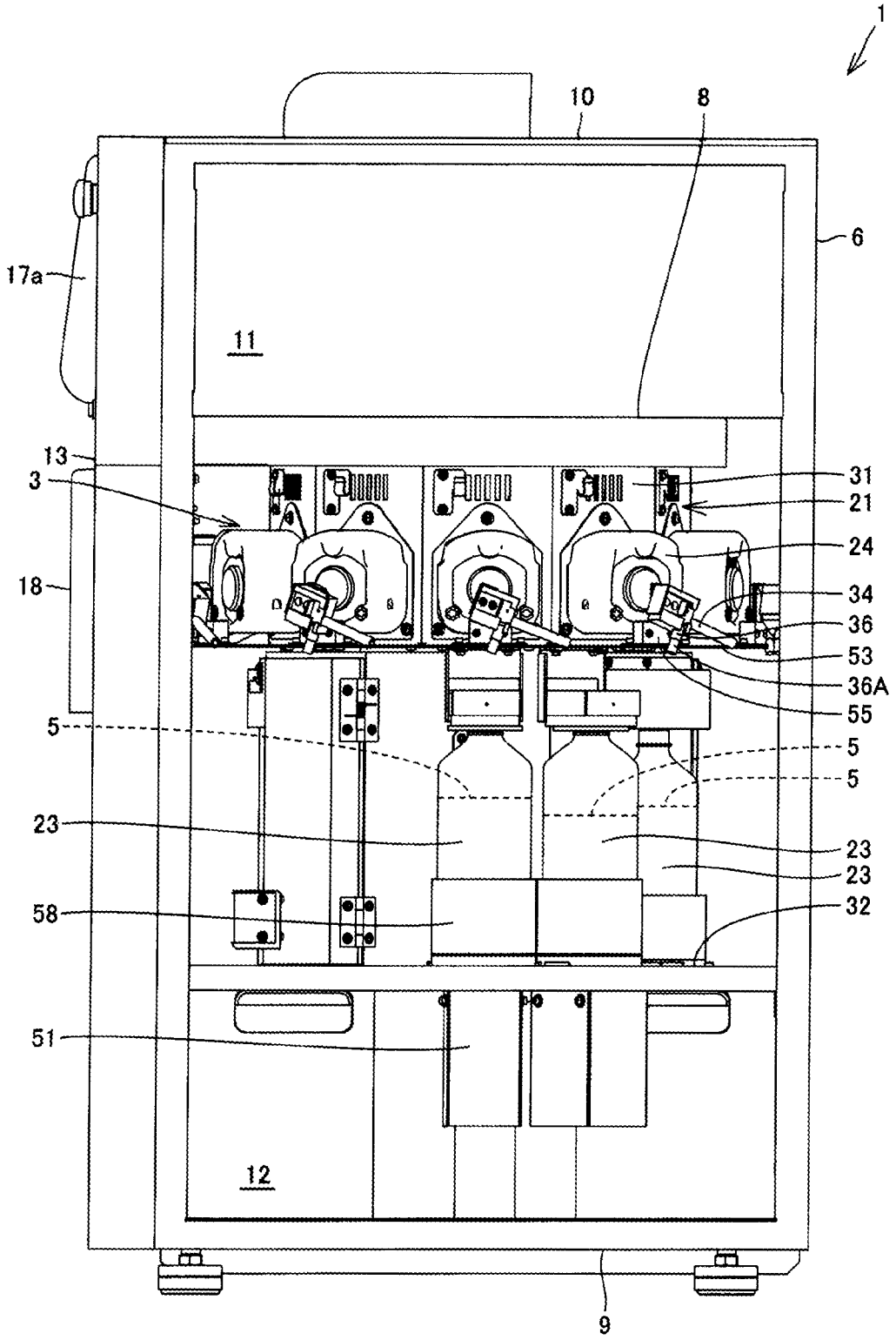
FIG. 3 is a cross sectional view of the liquid medication dispensing machine taken along the line III-III shown in FIG. 2.
Figure 4:
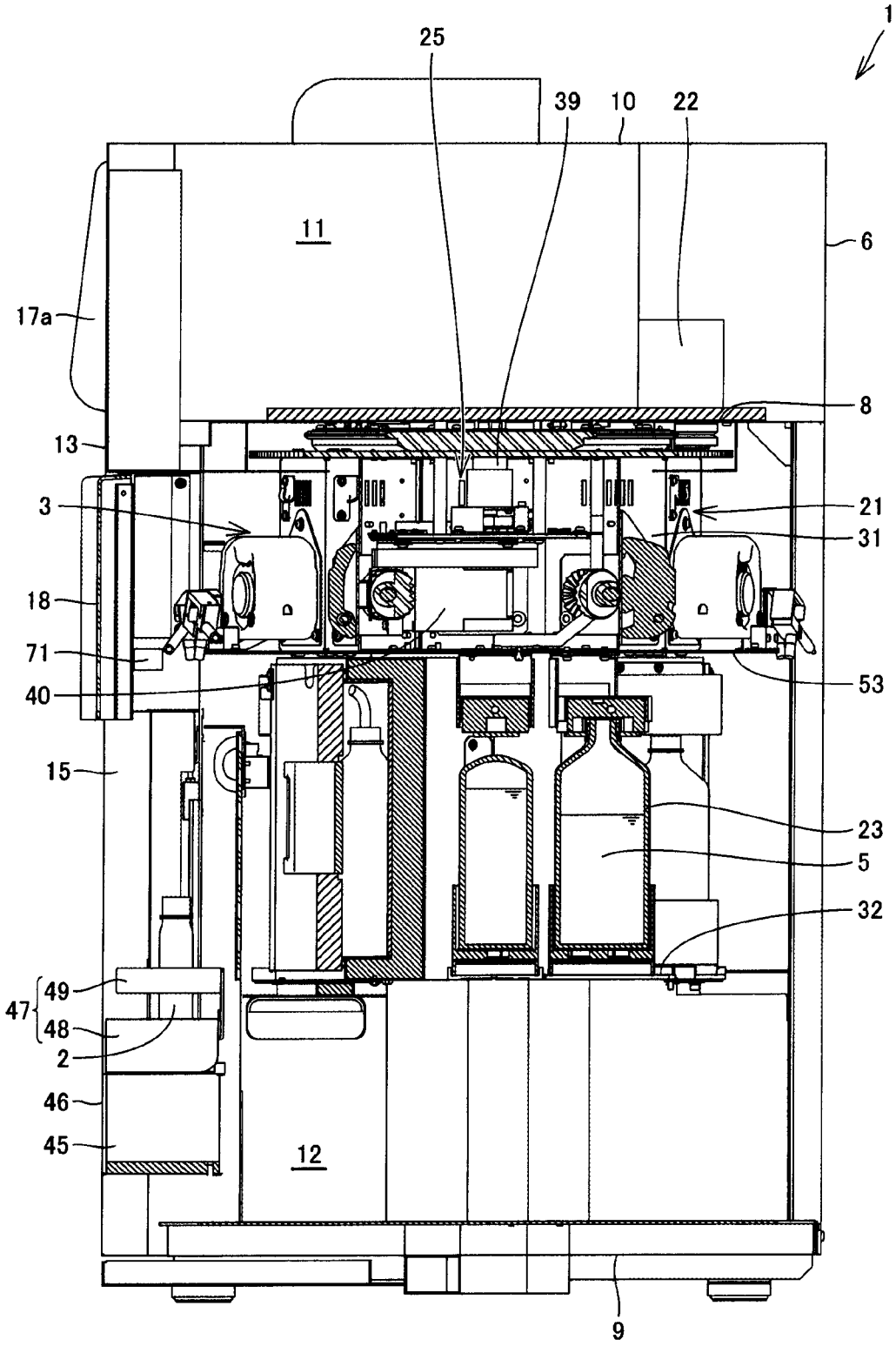
FIG. 4 is a cross sectional view of the liquid medication dispensing machine taken along the line IV-IV shown in FIG. 2.
Figure 5:
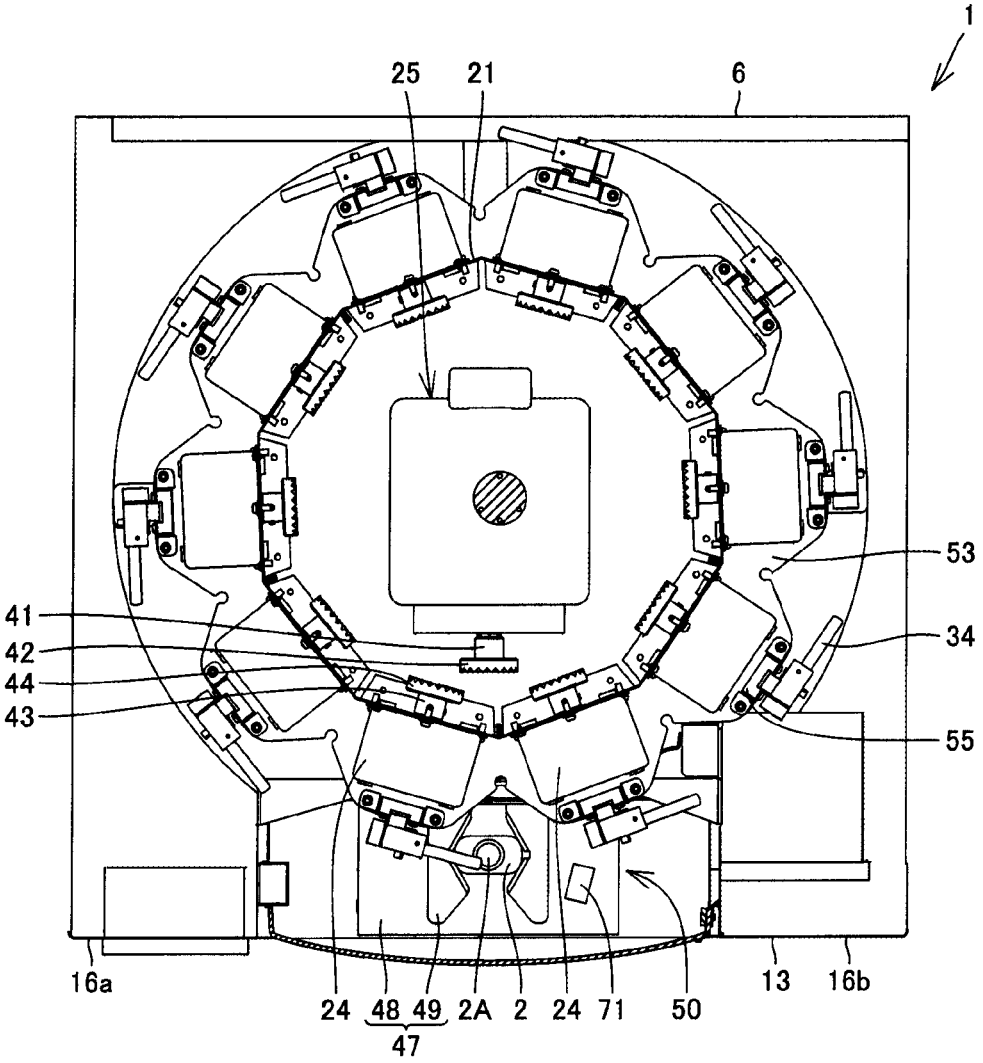
FIG. 5 is a cross sectional view of the liquid medication dispensing machine taken along the line V-V shown in FIG. 2.

FIG. 1 is a perspective view showing a structure of a liquid medication dispensing machine 1 of one embodiment of the present invention. FIG. 2 is a front view of liquid medication dispensing machine 1 shown in FIG. 1. FIG. 3 is a cross sectional view of liquid medication dispensing machine 1 taken along the line III-III shown in FIG. 2. FIG. 4 is a cross sectional view of liquid medication dispensing machine 1 taken along the line IV-IV shown in FIG. 2. FIG. 5 is a cross sectional view of liquid medication dispensing machine 1 taken along the line V-V shown in FIG. 2. Liquid medication dispensing machine 1 of the present embodiment is used to supply and dispense a liquid medication 5 which is a liquid state medicine from a liquid medication bottle 23 containing liquid medication 5 to a prescription bottle 2 in accordance with a prescription for a patient.

Liquid medication dispensing machine 1 includes a liquid medicine supply unit 3 supplying a liquid medication 5 from a liquid medication bottle 23 to a prescription bottle 2 and a weight detection unit 4 detecting the weight of liquid medication 5 contained in prescription bottle 2. The volume of liquid medication 5 supplied to prescription bottle 2 is calculated from the weight of liquid medication 5 detected by weight detection unit 4 and the specific gravity of liquid medication 5. Liquid medication supply unit 3 is controlled such that a predetermined volume of liquid medication 5 in accordance with the prescription is supplied to prescription bottle 2. Liquid medication supply unit 3 and weight detection unit 4 are provided in a housing 6. Housing 6 has a rectangular parallelepiped shape, and is installed on a horizontal installation surface in an upright position.

A support frame 8 is provided inside housing 6. Support frame 8 is located between a bottom plate 9 of housing 6 and a top plate 10 of housing 6, and in more detail, located closer to top plate 10 of housing 6. The internal space of housing 6 is divided by support frame 8 into an upper space 11 above support frame 8 and a lower space 12 below support frame 8. A touch panel 14 and printers 17*a*, 17*b* are located in a front section 13 of housing 6. A lower opening 15 by which lower space 12 communicates with the outside of housing 6 is also formed in front section 13.

Lower opening 15 is formed between both side portions 16*a*, 16*b* in front section 13 of housing 6. Above lower opening 15 between both side portions 16*a*, 16*b*, a curved plate-like front cover portion 18 is located which separates lower space 12 and the outside of housing 6. Front cover portion 18 is made of a transparent material such that lower space 12 is visible from outside the front side of housing 6. Front cover portion 18 is attached to one of both side portions 16*a*, 16*b* with a hinge and is provided to be pivotable around the axis of the hinge, so that front cover portion 18 can be opened/closed.

Liquid medication supply unit 3 has a rotation drum 21 which is a rotator located in lower space 12 and provided rotatably around an axis line (hereinbelow a "drum axis line") normal to support frame 8 and a drum rotating motor 22 mounted on the upper surface of support frame 8 and rotating rotation drum 21 around the drum axis line relative to support frame 8. Liquid medication supply unit 3 also has a plurality of pumps 24 provided for rotation drum 21 and transporting a liquid medication from a plurality of liquid medication bottles 23 containing liquid medication 5 to prescription bottle 2, and a pump driving unit 25 driving each pump 24. Each pump 24 may be a tube pump.

Rotation drum 21 has a pump holder 31 holding each pump 24 and a liquid medication bottle holder 32 holding each liquid medication bottle 23 in an upright position such that an opening is open upward. Liquid medication bottle holder 32 is provided below pump holder 31 and has an annular flat plate shape in plan view. On pump holder 31, respective pumps 24 are located at intervals in a circumferential direction of a virtual circle around the drum axis line (hereinbelow a "drum circumferential direction"). On liquid medication bottle holder 32, respective liquid medication bottles 23 are located at intervals in the drum circumferential direction.

The number of liquid medication bottles 23 and pumps 24 mounted on rotation drum 21 in the present embodiment can be optionally changed according to the purpose. A plurality of different types of liquid medications 5 may be contained in plurality of liquid medication bottles 23, respectively. Heavily used liquid medication 5 of the same type may be contained in plurality of liquid medication bottles 23. Alternatively, a diluent, such as water or simple syrup, may be contained in one or a plurality of liquid medication bottles 23.

Pump driving unit 25 selectively drives each of pumps 24, so that liquid medications 5 are selectively supplied from plurality of liquid medication bottles 23 to prescription bottle 2. A coupling member 42 is fixed at the leading end of drive shaft 41 rotationally driven by pump driving unit 25. A coupled member 44 to be coupled to coupling member 42 is fixed to a rotary shaft 43 of the rotor of each pump 24. When coupling member 42 and coupled member 44 are coupled to each other, rotary force is transmitted to pump 24. Each pump 24 is constructed to be driven individually in conjunction with the rotation of rotation drum 21.

Pump driving unit 25 has a pump driving motor 40 driving pump 24 and a moving motor 39 moving pump driving motor 40. By driving moving motor 39, pump driving motor 40 is moved forward and backward. By this movement of pump driving motor 40, a switch can be made between a coupled state in which coupling member 42 of pump driving motor 40 is coupled to coupled member 44 of pump 24 and a decoupled state in which coupling member 42 is not coupled to coupled member 44. Rotation drum 21 can be smoothly rotated relative to support frame 8 in the decoupled state.

By rotating rotation drum 21 in the decoupled state, rotation drum 21 is moved to a position where coupled member 44 of specific pump 24 selected based on prescription information input to liquid medication dispensing machine 1 faces coupling member 42. After the rotation of rotation drum 21, a switch is made to the coupled state in which coupling member 42 is coupled to coupled member 44. The selected specific pump 24 can thereby be driven to dispense liquid medication 5 supplied from a desired liquid medication bottle 23 into prescription bottle 2. Although coupling member 42 and coupled member 44 are both performed by gears, they may have any structure that can transmit motive power.

Plurality of liquid medication bottles 23 are mounted on liquid medication bottle holder 32 of rotation drum 21. A plurality of cups 58 for holding liquid medication bottles 23, respectively, are attached to the upper side of liquid medication bottle holder 32. Cup 58 has a bottomed hollow cylindrical shape. Cup 58 serves as a holder holding liquid medication bottle 23. Liquid medication bottle 23 is received in cup 58, and the bottom of liquid medication bottle 23 is held by cup 58.

A rotationally driving unit 51 generating rotary force is located under liquid medication bottle holder 32. Rotationally driving unit 51 rotates liquid medication bottle 23 along the centerline of liquid medication bottle 23. Along with this rotation of liquid medication bottle 23, liquid medication 5 contained in liquid medication bottle 23 flows inside liquid medication bottle 23 in the circumferential direction on the cylindrical side portion of liquid medication bottle 23 along the direction of rotation of liquid medication bottle 23. By producing the flow of liquid medication 5 contained in liquid medication bottle 23, liquid medication 5 is stirred in liquid medication bottle 23.

Pump 24 corresponding to each of plurality of liquid medication bottles 23 is provided for pump holder 31 of rotation drum 21. A nozzle attachment plate 53 which is an annular flat plate is provided at the lower end of pump holder 31. Nozzle attachment plate 53 is located above liquid medication bottle holder 32. Nozzle attachment plate 53 and liquid medication bottle holder 32 are parallel to each other, and are constructed to be capable of rotating on a horizontal plane together with rotation drum 21 around the drum axis line. With the rotation of rotation drum 21, plurality of liquid medication bottles 23, pumps 24 and supply nozzles 36 also rotate integrally in the horizontal direction. Rotation drum 21 has a function as a supply pipe moving unit that moves a supply pipe 60, which will be described later, including supply nozzles 36.

Supply nozzle 36 is attached onto the same circumference as the outer circumferential part of nozzle attachment plate 53. Respective supply nozzles 36 are located on nozzle attachment plate 53 at equal intervals in the drum circumferential direction on a virtual circle centered on a drum axis line. Prescription bottle 2 has an upper opening 2A formed therein. Plurality of supply nozzles 36 are each constructed such that a supply port 36A can be moved relative to upper opening 2A of prescription bottle 2. When supply port 36A of supply nozzle 36 is moved relative to upper opening 2A of prescription bottle 2, plurality of supply ports 36A are located to face upper opening 2A one by one.

Supply nozzle 36 is located at an inclination of a predetermined angle from the drum axis line. Liquid medication 5 flowing out through supply port 36A of supply nozzle 36 is supplied to prescription bottle 2 via upper opening 2A of prescription bottle 2. Since supply nozzle 36 is located at an inclination from the drum axis line, liquid medication 5 to be infused into prescription bottle 2 flows on the inner circumferential sidewall of prescription bottle 2. This can prevent liquid medication 5 from foaming in prescription bottle 2. An attachment part 55 is fixed on the upper side of nozzle attachment plate 53. Supply nozzle 36 is provided to be optionally attachable/detachable to/from attachment part 55, and is attached to nozzle attachment plate 53 with attachment part 55 interposed therebetween.

Weight detection unit 4 is located in lower opening 15. Weight detection unit 4 has an electronic balance 45, a casing 46 storing electronic balance 45, and a prescription bottle holder 47 mounted on and fixed to electronic balance 45 and holding prescription bottle 2 in an upright position such that upper opening 2A is open upward. Electronic balance 45 detects the weight of liquid medication 5 supplied to prescription bottle 2. When the weight of liquid medication 5 reaches a predetermined value, liquid medication supply unit 3 stops driving of pump 24 to stop supply of liquid medication 5 to prescription bottle 2. Electronic balance 45 may be of any type, such as tuning fork, load cell or electromagnetic type. Casing 46 is provided at a lower position of front section 13 of housing 6 between both side portions 16*a*, 16*b*. Prescription bottle holder 47 has a table 48 on which prescription bottle 2 is mounted and a holding fixture 49 provided above table 48 and holding prescription bottle 2.

Weight detection unit 4 is moved up and down by an elevating device 50 as a driving unit shown in FIG. 5. Elevating device 50 moves weight detection unit 4 in the vertical direction so as to be located at two positions, a mount/dismount position and a dispense position, and accordingly moves prescription bottle 2 mounted on table 48 of weight detection unit 4. The mount/dismount position is a position where prescription bottle 2 is mounted on table 48 of liquid medication dispensing machine 1 or where prescription bottle 2 is dismounted from table 48. The dispense position is a position where prescription bottle 2 and supply nozzle 36 come closer to each other than at the mount/dismount position so that liquid medication 5 is supplied to prescription bottle 2 for dispensing. By means of elevating device 50, prescription bottle 2 is reciprocally moved between the outside and the inside of housing 6 of liquid medication dispensing machine 1 so as to reciprocate between the mount/dismount position and the dispense position.

A spray nozzle 71 facing supply port 36A of supply nozzle 36 is located at the front face side of housing 6 in lower space 12. Spray nozzle 71 sprays air to supply port 36A to remove liquid medication 5 adhering to supply port 36A from supply port 36A. Spray nozzle 71 is attached to any of members constituting housing 6 with a metal support member. For example, spray nozzle 71 may be attached to the inner face side of front cover portion 18. Any widely known structure can be used as a support structure for locating spray nozzle 71 at a predetermined position.

Figure 6:
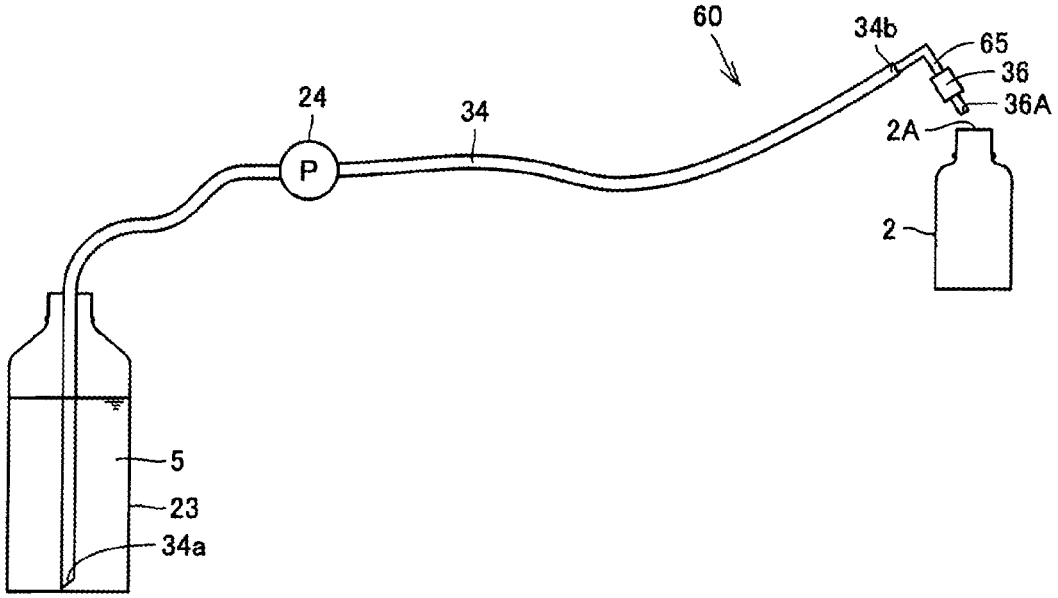
FIG. 6 is a schematic diagram showing an overall structure of a supply pipe.

FIG. 6 is a schematic diagram showing an overall structure of supply pipe 60. Supply pipe 60 forms a path along which liquid medication 5 flows from liquid medication bottle 23 to prescription bottle 2. Liquid medication dispensing machine 1 includes a plurality of supply pipes 60 such that different liquid medications 5 can be supplied respectively from plurality of liquid medication bottles 23 to prescription bottle 2.

Supply pipe 60 includes supply nozzle 36 described above, a tube 34 and an elbow member 65. Tube 34 has a suction end 34*a* which is one end, and a discharge end 34*b* which is the other end. Open suction end 34*a* of tube 34 is located in liquid medication bottle 23, and is immersed in liquid medication 5 in liquid medication bottle 23. Suction end 34*a* is an end on the side where liquid medication 5 is sucked into tube 34 when liquid medication 5 is supplied from liquid medication bottle 23 to prescription bottle 2. Discharge end 34*b* is an end on the side where liquid medication 5 is discharged from tube 34 when liquid medication 5 is supplied from liquid medication bottle 23 to prescription bottle 2. Discharge end 34*b* of tube 34 is attached to elbow member 65. Elbow member 65 couples tube 34 and supply nozzle 36.

Supply port 36A which is an open end of supply nozzle 36 forms an end of supply pipe 60 on the prescription bottle 2 side. The one end of supply pipe 60 is located to face upper opening 2A of prescription bottle 2. When liquid medication 5 in liquid medication bottle 23 is supplied to prescription bottle 2, supply port 36A of supply nozzle 36 is located to face upper opening 2A of prescription bottle 2. Liquid medication 5 passes through the one end of supply pipe 60 and flows out of supply pipe 60 toward prescription bottle 2. Suction end 34*a* of tube 34 forms the other end of supply pipe 60 on the liquid medication bottle 23 side. The other end of supply pipe 60 is inserted into liquid medication bottle 23, and is immersed in liquid medication 5 contained in liquid medication bottle 23.

Pump 24 is used as a motive power source for sucking liquid medication 5 in liquid medication bottle 23 toward supply nozzle 36. If pump 24 is a tube pump, an intermediate part of tube 34 between suction end 34*a* and discharge end 34*b* is inserted through pump 24, and is held by pump 24 so as to be attached/detached thereto/therefrom.

By the driving of pump 24, liquid medication 5 in liquid medication bottle 23 is sucked at suction end 34*a* into supply pipe 60, flows through supply pipe 60, and flows out of supply pipe 60 via supply port 36A of supply nozzle 36. Liquid medication 5 flown out of supply pipe 60 flows into prescription bottle 2 via upper opening 2A of prescription bottle 2. In this manner, liquid medication 5 is transported from each of plurality of liquid medication bottles 23 to prescription bottle 2 via supply pipe 60, and liquid medication 5 is supplied to prescription bottle 2. By selecting the combination of liquid medication bottles 23 and supply pipes 60, a different type of liquid medication 5 or a diluent is selectively supplied to prescription bottle 2.

Figure 7:
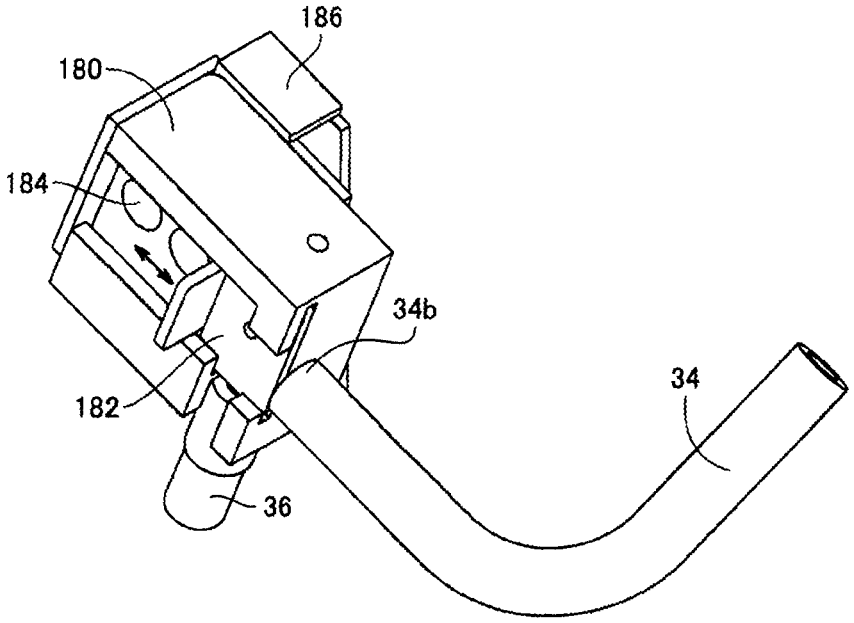
FIG. 7 is a perspective view showing a coupling portion of a tube and a supply nozzle.
Figure 8:
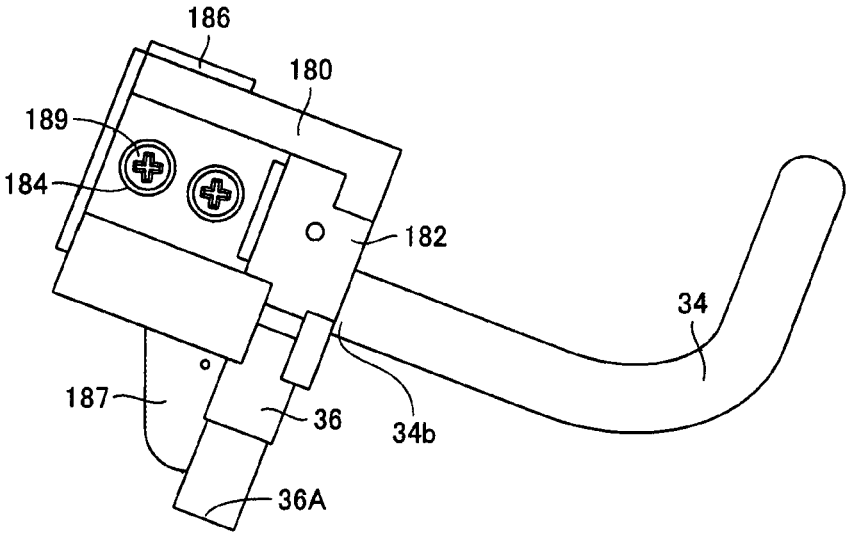
FIG. 8 is a front view showing the coupling portion of the tube and the supply nozzle.
Figure 9:
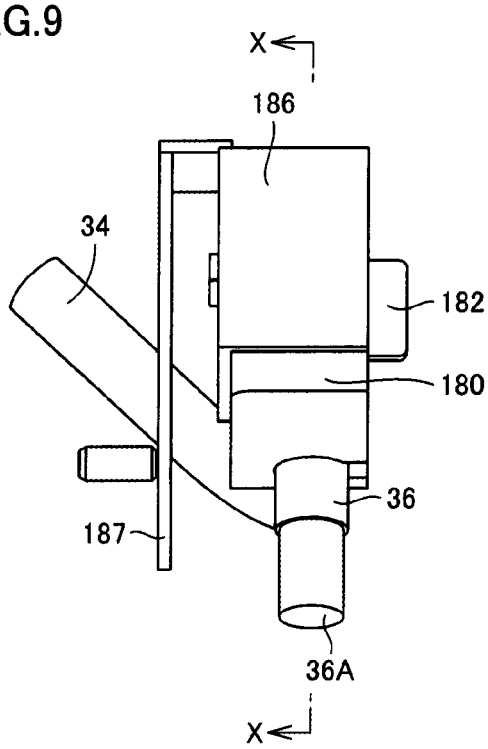
FIG. 9 is a side view showing the coupling portion of the tube and the supply nozzle.
Figure 10:
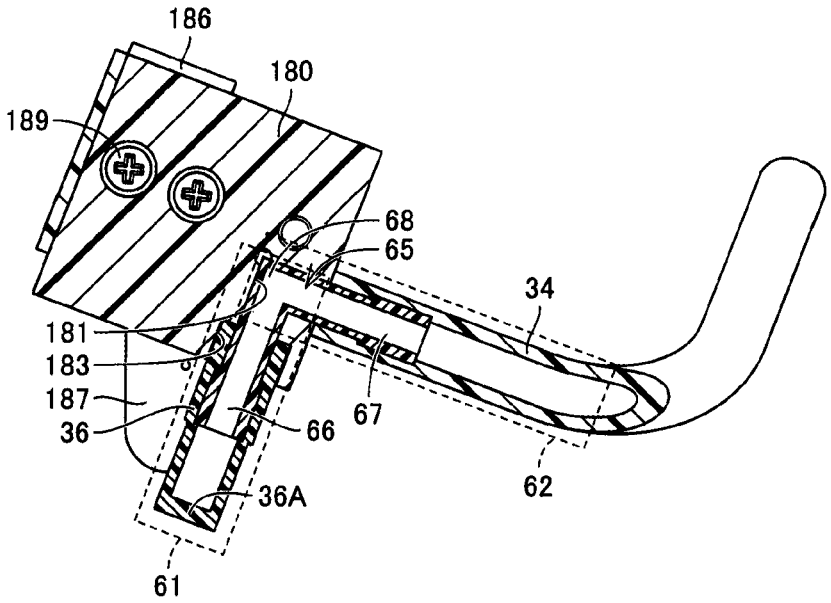
FIG. 10 is a cross sectional view taken along the line X-X shown in FIG. 9.
Figure 11:
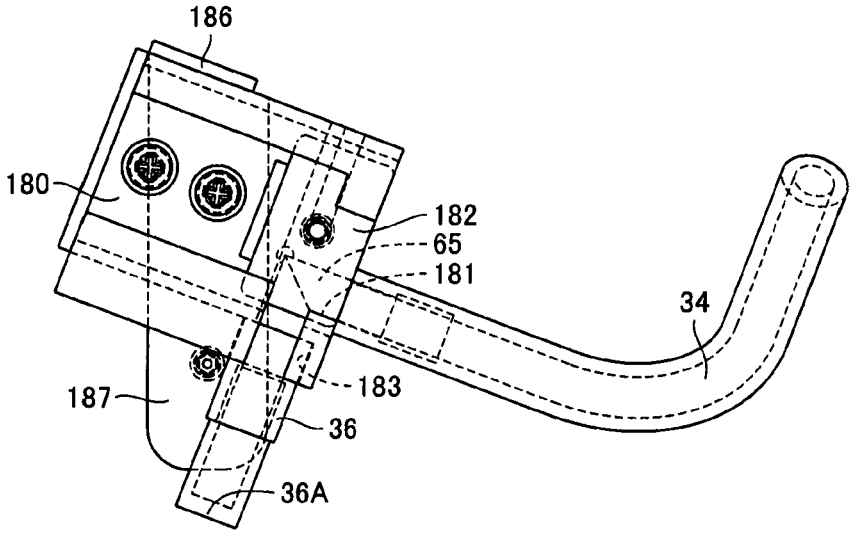
FIG. 11 is an internal perspective view showing the coupling portion of the tube and the supply nozzle.

The structure and arrangement of supply pipe 60 will be described below. FIG. 7 is a perspective view showing a coupling portion of tube 34 and supply nozzle 36. FIG. 8 is a front view showing the coupling portion of tube 34 and supply nozzle 36. FIG. 9 is a side view showing the coupling portion of tube 34 and supply nozzle 36. FIG. 10 is a cross sectional view taken along the line X-X shown in FIG. 9. FIG. 11 is an internal perspective view showing the coupling portion of tube 34 and supply nozzle 36. It is noted that FIGS. 7 to 11 illustrate only part of tube 34 in proximity to discharge end 34*b* thereof, and illustration of most part of tube 34 is omitted.

Elbow member 65 as an example of a bent member has a 90° elbow shape as particularly clearly shown in FIGS. 10 and 11. Elbow member 65 has a straight cylindrical first arm portion 66, a straight cylindrical second arm portion 67 extending perpendicularly to the extending direction of first arm portion 66, and a bent portion 68 that couples first arm portion 66 and second arm portion 67. Bent portion 68 has a function as a coupling portion that couples first arm portion 66 and second arm portion 67. Since the pipeline is bent at bent portion 68 and first arm portion 66 and second arm portion 67 are provided at the opposite ends of bent portion 68, elbow member 65 having a 90° elbow shape is formed.

It is noted that first arm portion 66, second arm portion 67 and bent portion 68 of elbow member 65 are features indicating the respective portions of elbow member 65, and they are not intended to indicate separate members. That is, for example, elbow member 65 may be formed by bending a straight cylindrical member, or may be formed as a molded resin. In these cases, first arm portion 66, second arm portion 67 and bent portion 68 are formed integrally.

As for the shape of elbow member 65, the illustrated 90° elbow shape is desirable in that a commercial item can be used and the cost can be reduced, however, it is not limited to the 90° elbow shape. The respective extending directions of first arm portion 66 and second arm portion 67 may form any angle, such as 45', for example. Bent portion 68 may have a gently curved shape rather than the bent shape. First arm portion 66 and second arm portion 67 may have a bent cylindrical shape rather than the straight cylindrical shape. In this case, part or all of the coupling portion coupling first arm portion 66 and second arm portion 67 may have a straight cylindrical shape. Elbow member 65 may have any shape as long as it can change the flow direction of liquid medication 5 passing through elbow member 65.

The end of first arm portion 66 on the side to be engaged with supply nozzle 36 is located at a lower side in the vertical direction than the end of first arm portion 66 on the bent portion 68 side, and the open end of second arm portion 67 is located at a lower side in the vertical direction than the end of second arm portion 67 on the bent portion 68 side. For example, second arm portion 67 may be arranged such that its extending direction has an angle larger than 0° with respect to the horizontal direction. Moreover, the angle formed by the extending direction of first arm portion 66 with respect to the horizontal direction may be set at a large angle to such an extent that liquid medication 5 will not be scattered out of prescription bottle 2 when liquid medication 5 flowing out through supply port 36A of supply nozzle 36 is infused into prescription bottle 2.

Supply nozzle 36 is attached to the outer circumferential side of first arm portion 66 of elbow member 65. By inserting first arm portion 66 into supply nozzle 36, supply nozzle 36 and elbow member 65 are engaged with each other. Tube 34 is attached to the outer circumferential side of second arm portion 67 of elbow member 65. By inserting second arm portion 67 into tube 34, tube 34 and elbow member 65 are engaged with each other.

Elbow member 65 is held by a holder member 180. Holder member 180 is a molded resin. Holder member 180 has formed therein an elbow fixing hole 181 for fixing elbow member 65. Elbow fixing hole 181 is formed by part of a surface of holder member 180 being depressed. Elbow fixing hole 181 is formed in a shape corresponding to elbow member 65, that is, a shape that can receive elbow member 65 therein.

Since the surface of holder member 180 is depressed and elbow fixing hole 181 is formed, elbow member 65 can be attached to elbow fixing hole 181 or elbow member 65 can be detached from elbow fixing hole 181 by moving elbow member 65 in the direction crossing (typically, perpendicular to) the extending direction of elbow member 65. Accordingly, elbow member 65 can easily be attached/detached to/from elbow fixing hole 181.

With elbow member 65 being attached to holder member 180, at least part of first arm portion 66 is located outside holder member 180, and at least part of second arm portion 67 is located outside holder member 180. Holder member 180 has formed therein a nozzle insertion hole 183 having a larger diameter than elbow fixing hole 181. Elbow fixing hole 181 and nozzle insertion hole 183 are formed concentrically. When supply nozzle 36 is attached to first arm portion 66, a part thereof is located in nozzle insertion hole 183.

When attached to the outer circumferential side of second arm portion 67, tube 34 is entirely located outside holder member 180. Holder member 180 is formed such that discharge end 34*b* of tube 34 attached to second arm portion 67 abuts on the outer surface of holder member 180. That is, elbow fixing hole 181 is formed so as to have a diameter smaller than the outer diameter of discharge end 34*b* of tube 34.

Holder member 180 is provided with a sliding portion 182 for fixing elbow member 65 in elbow fixing hole 181. Formed in part of the outer surface of holder member 180 is a groove shape that receives sliding portion 182 and allows sliding portion 182 to slide relatively with respect to holder member 180. Sliding portion 182 is allowed to move in the directions of the double-headed arrow shown in FIG. 7 along the direction in which the groove shape extends. Sliding portion 182 is formed of, for example, a metal material having greater rigidity than the material forming holder member 180.

Sliding portion 182 is formed so as to be positionable at a position that covers elbow fixing hole 181 with a ball type latch, for example. By positioning sliding portion 182, elbow member 65 received in elbow fixing hole 181 is covered by sliding portion 182. Accordingly, elbow member 65 is positioned on holder member 180, and in addition, elbow member 65 is prevented from being removed from elbow fixing hole 181 on its own.

When attaching elbow member 65 to holder member 180, elbow member 65 is first located in elbow fixing hole 181. At this time, tube 34 may or may not be attached to elbow member 65, while supply nozzle 36 is not attached to elbow member 65. After elbow member 65 is received in elbow fixing hole 181, sliding portion 182 is slidingly moved to position elbow member 65 by sliding portion 182.

Then, supply nozzle 36 is moved closer to elbow member 65 along the extending direction of first arm portion 66 of elbow member 65, and first arm portion 66 is inserted in supply nozzle 36, and further, supply nozzle 36 is fitted within nozzle insertion hole 183 of holder member 180. The inner diameter of nozzle insertion hole 183 is slightly smaller than the outer diameter of supply nozzle 36. Supply nozzle 36 is made of a material which is very flexible and easy to deform elastically, such as rubber or synthetic resin, for example. Therefore, when inserting supply nozzle 36 into nozzle insertion hole 183, supply nozzle 36 elastically deforms such that its outer diameter becomes slightly smaller, so that supply nozzle 36 closely contacts the inner wall of nozzle insertion hole 183.

Accordingly, supply nozzle 36 is firmly attached to holder member 180, which prevents supply nozzle 36 from being displaced or withdrawn from elbow member 65. In addition, since first arm portion 66 of elbow member 65 is inserted through supply nozzle 36, supply nozzle 36 is reliably positioned on holder member 180, and at the same time, elbow member 65 is also reliably positioned on holder member 180.

Holder member 180 is fixed to an interposed member 186 made of a metal material. Holder member 180 has formed therein a bolt insertion hole 184 extending through holder member 180 in its thickness direction. Holder member 180 and interposed member 186 are integrally fixed by inserting a fixing bolt 189 in the bolt insertion hole 184 side and causing a nut to be threadedly engaged with fixing bolt 189. By forming a plurality of bolt insertion holes 184 in holder member 180 and fixing holder member 180 and interposed member 186 at several places, holder member 180 and interposed member 186 are fixed with higher reliability, and holder member 180 can be prevented from being displaced relative to interposed member 186.

Interposed member 186 has a flat plate-like leg 187. As shown in FIG. 9, leg 187 is provided away from a body part of interposed member 186 fixed to holder member 180. Leg 187 has a long plate shape extending in one direction and having a longitudinal direction in that direction.

When leg 187 is engaged with attachment part 55 fixed to nozzle attachment plate 53, interposed member 186 is attached to attachment part 55. By fitting leg 187 into a receiving hole formed in attachment part 55, interposed member 186 is attached to attachment part 55. By removing leg 187 from the receiving hole, interposed member 186 is detached from attachment part 55. By attaching interposed member 186 to attachment part 55, supply nozzle 36 is attached to rotation drum 21, so that supply nozzle 36 can be rotated integrally with rotation drum 21.

When interposed member 186 is attached to attachment part 55, interposed member 186 is located such that the longitudinal direction of leg 187 is in parallel to the direction of the drum axis line. The direction in which the receiving hole formed in attachment part 55 extends is in parallel to the direction of the drum axis line. Interposed member 186 is arranged such that the extending direction of leg 187 is in parallel to the direction of the drum axis line by inserting leg 187 into the receiving hole along the direction in which the hole extends.

As shown in FIG. 11, the extending directions of first arm portion 66 and second arm portion 67 of elbow member 65 are inclined with respect to the extending direction of leg 187. Since liquid medication dispensing machine 1 is usually placed on a flat floor, the direction of the drum axis line is typically the vertical direction. Therefore, when leg 187 is attached to attachment part 55, the extending directions of first arm portion 66 and second arm portion 67 of elbow member 65 become inclined with respect to the vertical direction. Accordingly, the flow of liquid medication 5 flowing from liquid medication bottle 23, via tube 34 and elbow member 65, to supply nozzle 36 and moving toward prescription bottle 2 forms an upflow flowing upward and a downflow flowing downward in elbow member 65.

As shown in FIG. 10, supply pipe 60 has a first portion 61 and a second portion 62. First portion 61 is a portion of supply pipe 60 located most closely to prescription bottle 2 including supply port 36A of supply nozzle 36 and ranging from supply port 36A to bent portion 68 via first arm portion 66 of elbow member 65. Second portion 62 is a portion of supply pipe 60 coupled to first portion 61 ranging from bent portion 68 to a portion in proximity to the end of tube 34 including discharge end 34*b* via second arm portion 67.

When leg 187 is inserted into the receiving hole of attachment part 55 and supply pipe 60 is attached to rotation drum 21 with interposed member 186 and holder member 180 interposed therebetween, first arm portion 66 and second arm portion 67 of elbow member 65 are inclined with respect to the vertical direction. Therefore, liquid medication 5 transported from liquid medication bottle 23 to prescription bottle 2 forms an upward flow when passing through second portion 62, and forms a downward flow when passing through first portion 61. First portion 61 forms a downflow of liquid medication 5 leading to supply port 36A of supply nozzle 36. Second portion 62 forms an upflow of liquid medication 5 toward first portion 61.

Of elbow member 65, bent portion 68 is located at the highest position in the vertical direction, and bent portion 68 is located above first arm portion 66 and second arm portion 67. First arm portion 66 of elbow member 65 is included in first portion 61. Second arm portion 67 of elbow member 65 is included in second portion 62. Therefore, the flow of liquid medication 5 flowing from tube 34 into elbow member 65, through second arm portion 67, and toward bent portion 68 becomes an upflow flowing upward in the vertical direction, and the flow of liquid medication 5 from bent portion 68, through first arm portion 66 and toward supply port 36A of supply nozzle 36 becomes a downflow flowing downward in the vertical direction.

In first portion 61 and second portion 62, the flow direction of liquid medication 5 with respect to the horizontal direction is set. In supply pipe 60, the path along which liquid medication 5 flows toward supply port 36A of supply nozzle 36 forming one end of supply pipe 60 may descend is thereby limited only to first portion 61. Of liquid medication 5 present in supply pipe 60, liquid medication 5 flowing out through supply port 36A by the action of gravity during a stop of pump 24 is limited only to liquid medication 5 in first portion 61.

Therefore, when supply of liquid medication 5 to prescription bottle 2 is completed and pump 24 is stopped, liquid medication 5 in supply pipe 60 can be prevented from dropping down from supply port 36A. With a conventional structure of supply pipe 60, second portion 62 in which liquid medication 5 flowing toward supply port 36A is an upflow is not coupled to first portion 61, and a some large amount of liquid medication 5 naturally drops down toward supply port 36A with the lapse of time after pump 24 is stopped. It was therefore difficult to avoid dropping of liquid medication 5 from supply port 36A.

In contrast, supply pipe 60 of the present embodiment has first portion 61 as a portion on the side closest to supply port 36A and second portion 62 as a portion coupled to first portion 61. The flow direction in the vertical direction of liquid medication 5 flowing through supply pipe 60 toward supply port 36A varies between the inside of first portion 61 and the inside of second portion 62. Accordingly, of liquid medication 5 present in supply pipe 60, liquid medication 5 which may flow toward supply port 36A by the action of gravity during a stop of pump 24 can be limited only to liquid medication 5 present in first portion 61 by adhering to the inner wall of elbow member 65 or supply nozzle 36, for example. By reducing the amount of liquid medication 5 flowing toward supply port 36A in accordance with gravity, liquid medication 5 can be prevented from dropping down from supply port 36A with higher reliability.

By shortening the extending length of first portion 61, the amount of liquid medication 5 remaining in first portion 61 can be reduced further, which is desirable. For example, the dimension of each component of supply pipe 60 may be determined such that the extending length of first portion 61 is shorter than the extending length of second portion 62.

Figure 12:
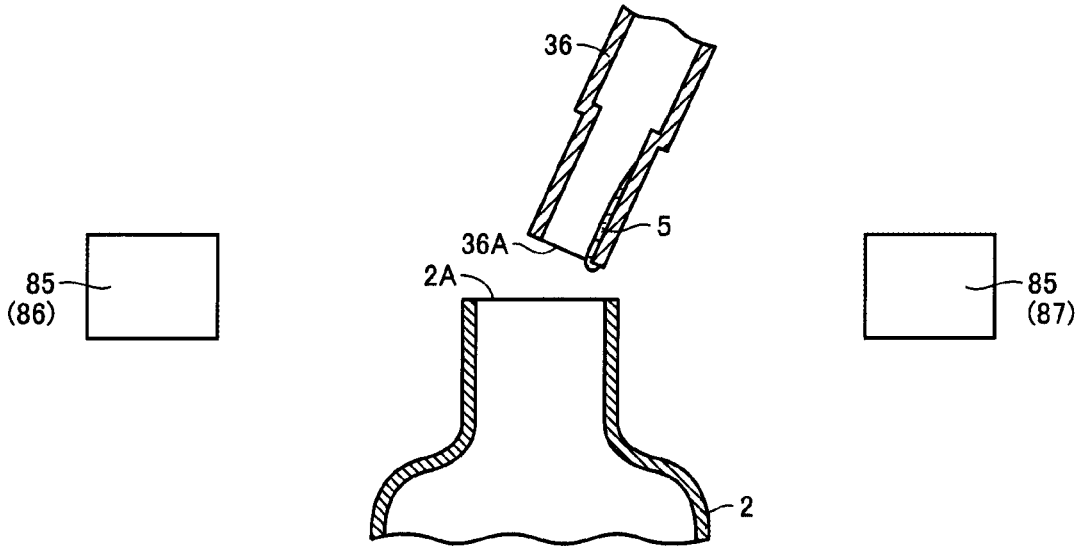
FIG. 12 is a partial schematic cross sectional view showing the supply nozzle facing an upper opening of a prescription bottle.

FIG. 12 is a partial schematic cross sectional view showing supply nozzle 36 facing upper opening 2A of prescription bottle 2. By arranging supply nozzle 36 at an inclination of a predetermined angle from the drum axis line, supply nozzle 36 is arranged at an inclination from the vertical direction of prescription bottle 2.

Liquid medication 5 flows from supply port 36A of supply nozzle 36 toward the inner circumferential sidewall of prescription bottle 2 for supply to prescription bottle 2. After supply of liquid medication 5 to prescription bottle 2 is finished, liquid medication 5 remaining in supply pipe 60 by adhering to the inner walls of elbow member 65 and supply nozzle 36 forming supply pipe 60, for example, flows downward by the action of gravity, and adheres to supply port 36A of supply nozzle 36.

Supply port 36A constitutes one end of supply pipe 60 at the side where liquid medication 5 toward prescription bottle 2 flows out from supply pipe 60. If liquid medication 5 adhering to supply port 36A is left alone, liquid medication 5 gathered at supply port 36A may drop down, and contamination of liquid medication 5 in prescription bottle 2 may occur. Alternatively, with liquid medication 5 adhering to supply port 36A, it may be difficult to supply an accurate amount of liquid medication 5 to prescription bottle 2. Therefore, it is required of liquid medication dispensing machine 1 that liquid medication 5 can be removed from supply port 36A.

Adhesion of liquid medication 5 to supply port 36A of supply nozzle 36 is detected by a sensor 85. Sensor 85 is a non-contact type sensor, and has a sending unit 86 sending a signal, such as an electromagnetic wave, light or acoustic signal, and a receiving unit 87 receiving the signal sent from sending unit 86. Sending unit 86 and receiving unit 87 are arranged to face each other with upper opening 2A of prescription bottle 2 and supply port 36A of supply nozzle 36 interposed therebetween.

If liquid medication 5 drops out of supply nozzle 36 through supply port 36A, the signal from sending unit 86 is intercepted by liquid medication 5. Sensor 85 can thereby detect adhesion of liquid medication 5 to supply port 36A. Sensor 85 is a sensor for detecting the position of prescription bottle 2. Since prescription bottle 2 moves up and down between the mount/dismount position and the dispense position as described above, liquid medication dispensing machine 1 requires a sensor for detecting that prescription bottle 2 is placed at a predetermined dispense position when supplying liquid medication 5 to prescription bottle 2. This sensor also serves to detect adhesion of liquid medication 5 to supply port 36A. Thus, the number of necessary sensors can be reduced, and the cost of liquid medication dispensing machine 1 can be reduced.

Figure 13:
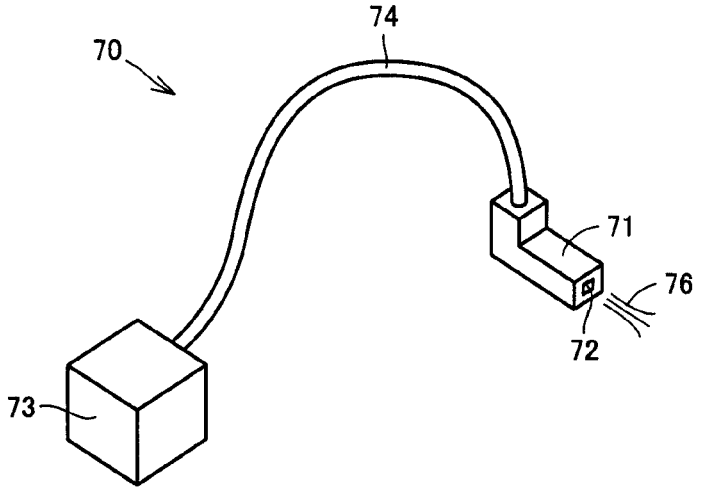
FIG. 13 is a schematic view showing a structure of a cleaning unit.

The structure and control method for removing liquid medication 5 adhering to supply port 36A of supply nozzle 36 from supply port 36A will be described below in detail. FIG. 13 is a schematic view showing a structure of a cleaning unit 70.

Cleaning unit 70 is a structure for removing liquid medication 5 adhering to supply port 36A from supply port 36A, and has spray nozzle 71, a fan 73 and an airflow pipe 74 for sending air from fan 73 to spray nozzle 71. Spray nozzle 71 has a blow hole 72 formed therein. Air supplied from fan 73 to spray nozzle 71 via airflow pipe 74 is ejected from blow hole 72 to form an air jet stream 76. Cleaning unit 70 has a function as an air injection unit that injects air from the outside to supply port 36A of supply nozzle 36. When liquid medication 5 remains in supply port 36A, air jet stream 76 ejected from blow hole 72 of spray nozzle 71 removes droplets of liquid medication 5 from supply port 36A.

Even if the flow direction of liquid medication 5 in supply pipe 60 is defined by first portion 61 and second portion 62 described above, liquid medication 5 remaining on the inner wall surface of first portion 61 of supply pipe 60 flows downward to the supply port 36A side by the action of gravity after supply of liquid medication 5 to prescription bottle 2 is finished, and tends to remain at supply port 36A. If liquid medication 5 remaining at supply port 36A increases and exceeds a predetermined amount, droplets of liquid medication 5 drop down from supply port 36A. Then, by providing cleaning unit 70 and removing liquid medication 5 remaining at supply port 36A with air jet stream 76 from supply port 36A, unintended dropping of droplets of liquid medication 5 from supply port 36A can be prevented with higher reliability.

Fan 73 is located at any place in housing 6 of liquid medication dispensing machine 1. For example, fans 73 may be arranged at the right and left corners at the back on the bottom of lower space 12 in housing 6. Blow hole 72 is formed to have an opening area smaller than the sectional area of airflow pipe 74 and the sectional area of the air passage in spray nozzle 71. By forming blow hole 72 in a throttle shape, air jet stream 76 ejected from blow hole 72 is sufficiently increased in pressure, which improves the capability to remove liquid medication 5 from supply nozzle 36.

Figure 14:
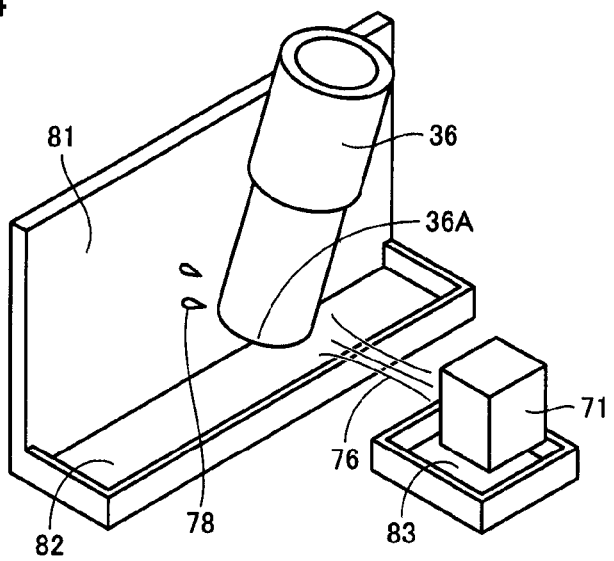
FIG. 14 is a schematic view showing a situation where a liquid medication is removed from the supply nozzle by the cleaning unit.

FIG. 14 is a schematic view showing the situation where liquid medication 5 is removed from supply nozzle 36 with cleaning unit 70. A plate-like receiving member 81 is provided at a position with supply nozzle 36 interposed between receiving member 81 and spray nozzle 71. Receiving member 81 is located downstream of supply port 36A along the flow of air jet stream 76. A bottomed container-like receiving member 82 is attached to the lower end of receiving member 81. Receiving member 82 receives liquid medication 5 removed from supply port 36A by air jet stream 76, and receives liquid medication 5 dropped downward from receiving member 81. By receiving droplet 78 scattered from supply port 36A with receiving members 81 and 82, droplet 78 blown off from supply port 36A by air jet stream 76 can be avoided from adhering to other components of liquid medication dispensing machine 1 with reliability.

A bottomed container-like receiving member 83 is provided under spray nozzle 71. Receiving member 83 also receives liquid medication 5 removed from supply port 36A by air jet stream 76. In addition to receiving members 81 and 82, by further providing receiving member 83, droplet 78 can be avoided from adhering to other components of liquid medication dispensing machine 1 with higher reliability.

As will be described later in detail, the cleaning position is set at a position different from the supply position where supply nozzle 36 should be located in order to supply liquid medication 5 from supply nozzle 36 to prescription bottle 2. Spray nozzle 71 sprays air jet stream 76 onto supply nozzle 36 located at the cleaning position. Therefore, spray nozzle 71 and receiving members 81, 82 and 83 do not interfere with supply of liquid medication 5 to prescription bottle 2. Spray nozzle 71 and receiving members 81, 82 and 83 shown in FIG. 14 are supported by housing 6 of liquid medication dispensing machine 1, and are not rotationally moved along with the rotation of rotation drum 21. Therefore, supply pipe 60 including supply nozzle 36 is provided to be capable of relatively moving with respect to spray nozzle 71 and receiving members 81, 82 and 83.

Cleaning unit 70 for removing liquid medication 5 from supply port 36A of supply nozzle 36 is not limited to the above-described structure that sprays air. Cleaning unit 70 may have any structure as long as it has a function capable of removing liquid medication 5 adhering to supply nozzle 36. For example, cleaning unit 70 may have a cleaning member, such as a brush, that cleans supply port 36A to remove liquid medication 5 from supply port 36A, or may have a structure capable of washing and drying supply port 36A. Alternatively, cleaning unit 70 may have an absorbing member for making contact with supply port 36A so that liquid medication 5 is permeated and absorbed or a structure that sucks and removes liquid medication 5 from supply port 36A.

Figure 15:
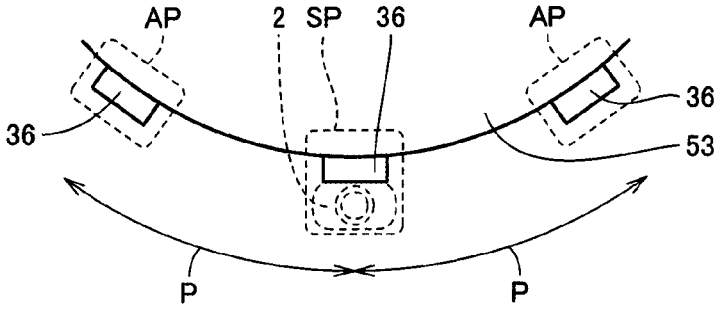
FIG. 15 is a first schematic view for illustrating the positional relationship between a supply position and a cleaning position.
Figure 16:
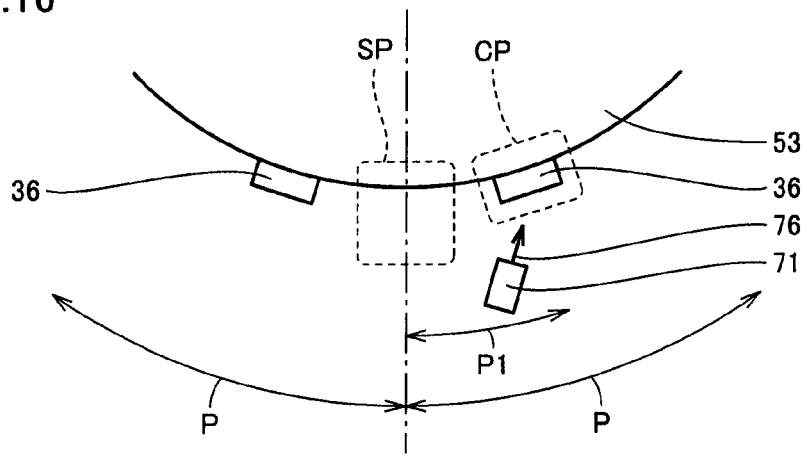
FIG. 16 is a second schematic view for illustrating the positional relationship between the supply position and the cleaning position.

FIGS. 15 and 16 are schematic views for illustrating the positional relationship between a supply position SP and a cleaning position CP. In FIGS. 15 and 16, part of nozzle attachment plate 53 shown in FIG. 5 is schematically shown in an arc shape centered on the drum axis line, and some supply nozzles 36 among plurality of supply nozzles 36 attached to nozzle attachment plate 53 are schematically shown. Plurality of supply nozzles 36 are arranged and located at equal intervals in the circumferential direction of the arc centered on the drum axis line. The distance between supply ports 36A of two adjacent supply nozzles 36 in the drum circumferential direction is shown as a spacing P in FIGS. 15 and 16.

In FIGS. 15 and 16, a broken line frame denoted as a reference character SP indicates supply position SP at which liquid medication 5 is supplied to prescription bottle 2 downward via supply nozzle 36. When supply nozzle 36 is at supply position SP, supply port 36A is located above upper opening 2A of prescription bottle 2, and supply port 36A faces upper opening 2A. Broken line frames denoted as reference characters AP indicate adjacent positions AP at which, when certain supply nozzle 36 is located at supply position SP, supply nozzles 36 adjacent to that supply nozzle 36 are located.

A broken line frame denoted as a reference character CP indicates cleaning position CP at which liquid medication 5 adhering to supply port 36A is removed from supply port 36A of supply nozzle 36. When supply nozzle 36 is at cleaning position CP, supply port 36A faces blow hole 72 of spray nozzle 71 of cleaning unit 70. When supply nozzle 36 is located at cleaning position CP, liquid medication 5 adhering to supply port 36A is blown off by air jet stream 76 ejected from blow hole 72, so that liquid medication 5 is removed from supply port 36A.

Since the distance between supply ports 36A of two adjacent supply nozzles 36 is spacing P, the distance between supply position SP and adjacent position AP along the arc centered on the drum axis line is spacing P, as shown in FIG. 15. On the other hand, the distance between supply position SP and cleaning position CP along the arc centered on the drum axis line is indicated as a distance P1 smaller than spacing P in FIG. 16. Spray nozzle 71 is located such that liquid medication 5 can be removed from supply nozzle 36 located between supply position SP and adjacent position AP. Cleaning position CP is provided at a position away from supply position SP by distance P1.

Typically, distance P1 is set at a half distance of spacing P. In this case, cleaning position CP is provided at a position away from supply position SP by a half distance of spacing P. Between spacing P and distance P1, the relationship of P1=P/2 holds.

Supply nozzle 36 is attached to nozzle attachment plate 53, and is rotationally moved around the drum axis line with the rotation of rotation drum 21. Supply nozzle 36 is moved along the drum circumferential direction which is the circumferential direction of a virtual circle centered on the drum axis line. Supply pipe 60 including supply nozzle 36 is moved in the drum circumferential direction with the rotation of rotation drum 21, and is relatively moved with respect to prescription bottle 2.

When nozzle attachment plate 53 shown in FIGS. 15 and 16 is rotated in the clockwise direction, supply nozzle 36 passes by adjacent position AP, cleaning position CP, supply position SP, and adjacent position AP in the order presented. At this time, supply nozzle 36 is moved to supply position SP after passing by cleaning position CP. Plurality of supply ports 36A are moved sequentially to supply position SP passing by cleaning position CP. Supply nozzle 36 is moved to supply position SP after liquid medication 5 is removed from supply port 36A at cleaning position CP, and liquid medication 5 is supplied to prescription bottle 2 from supply nozzle 36 having been cleaned. By cleaning supply port 36A immediately before supply of liquid medication 5 to prescription bottle 2, liquid medication 5 can be stably supplied to prescription bottle 2, so that the amount of supply of liquid medication 5 to prescription bottle 2 can be improved in accuracy.

After being cleaned at cleaning position CP, supply nozzle 36 passes above upper opening 2A facing upper opening 2A of prescription bottle 2. Then, liquid dropping from supply nozzle 36 passing above upper opening 2A can be prevented. Therefore, occurrence of contamination in which liquid medication 5 of a type that is not planned to be supplied to prescription bottle 2 is mixed into prescription bottle 2 can be prevented.

When nozzle attachment plate 53 is rotated in the counterclockwise direction, supply nozzle 36 passes by adjacent position AP, supply position SP, cleaning position CP, and adjacent position AP in the order presented. At this time, supply nozzle 36 is moved to cleaning position CP after passing by supply position SP. Plurality of supply ports 36A are moved sequentially from supply position SP to cleaning position CP. Supply nozzle 36 having supplied liquid medication 5 to prescription bottle 2 at supply position SP is moved to cleaning position CP immediately thereafter. By cleaning supply port 36A immediately after the supply of liquid medication 5 to prescription bottle 2, liquid medication dispensing machine 1 can be prevented from getting dirty due to liquid dropping of liquid medication 5 into liquid medication dispensing machine 1, and occurrence of contamination can be prevented with higher reliability.

Cleaning position CP is provided between supply position SP and adjacent position AP. Cleaning position CP is provided at a position away from supply position SP by a distance smaller than spacing P in the drum circumferential direction. When cleaning supply port 36A at cleaning position CP, supply port 36A subjected to cleaning is at a position not facing upper opening 2A of prescription bottle 2. This can prevent liquid medication 5 removed from supply port 36A during cleaning from being mixed into prescription bottle 2. When cleaning supply port 36A at cleaning position CP, another supply nozzle 36 adjacent to supply nozzle 36 subjected to cleaning is at a position not facing upper opening 2A of prescription bottle 2. This can prevent liquid medication 5 from dropping down from the other supply nozzle 36 during cleaning and being mixed into prescription bottle 2.

Cleaning position CP is set at the center between supply position SP and adjacent position AP. Distance P1 between supply position SP and cleaning position CP is set at half of spacing P between supply ports 36A of two adjacent supply nozzles 36. Supply nozzle 36 during cleaning is located at the farthest position from both supply position SP and adjacent position AP in the drum circumferential direction. Accordingly, the effect that can prevent mixing of liquid medication 5 into prescription bottle 2 from supply nozzle 36 subjected to cleaning or from another supply nozzle 36 adjacent to supply nozzle 36 subjected to cleaning can be obtained more prominently.

The alternate long and short dash line shown in FIG. 16 is a straight line passing through the drum axis line and supply position SP, extends in the radial direction of a virtual circle centered on the drum axis line, and is perpendicular to the drum circumferential direction. Cleaning unit 70 is located such that the flow direction of air jet stream 76 blown off from spray nozzle 71 is getting away from the alternate long and short dash line shown in FIG. 16. The air blown off from spray nozzle 71 flows in a direction away from supply position SP, which is different from the direction toward supply position SP. Such arrangement of cleaning unit 70 can prevent liquid medication 5 removed from supply port 36A during cleaning from being scattered into prescription bottle 2 with higher reliability.

Spray nozzle 71 is located at the front face side in housing 6 of liquid medication dispensing machine 1. The flow direction of air jet stream 76 blown off from spray nozzle 71 is a direction from the front face side toward the back side of liquid medication dispensing machine 1. The air blown off from spray nozzle 71 flows in the direction from the outside to the inner side of liquid medication dispensing machine 1 to be sprayed onto supply nozzle 36. Such arrangement of cleaning unit 70 can prevent liquid medication 5 removed from supply port 36A during cleaning from being scattered to the outside of liquid medication dispensing machine 1 with higher reliability.

Figures 17, 18, 19:
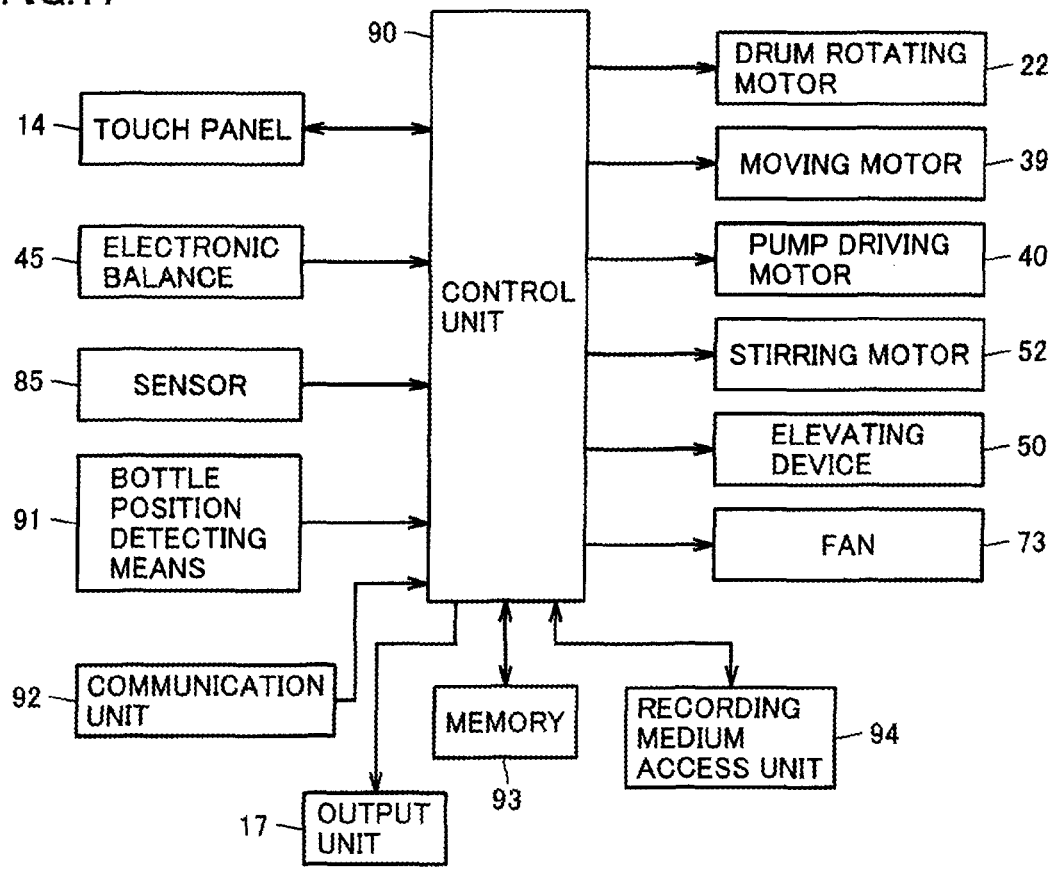
FIG. 17 is a block diagram showing a structure of the liquid medication dispensing machine.
FIG. 18 shows an example of a table showing setting for performing nozzle cleaning.
FIG. 19 shows an example of a table showing setting of time related to nozzle cleaning.

FIG. 17 is a block diagram showing a structure of liquid medication dispensing machine 1. As shown in FIG. 17, liquid medication dispensing machine 1 includes a control unit 90 that controls the operation of liquid medication dispensing machine 1 as a whole. Touch panel 14 serves as an input unit on which various parameters related to the operation of liquid medication dispensing machine 1, such as prescription data, and various types of information, such as patient's name and pharmacist's name, are input. Touch panel 14 also serves as a display unit that displays the operating state of liquid medication dispensing machine 1. Liquid medication dispensing machine 1 may include, as a display unit, a lamp that lights up when a malfunction of liquid medication dispensing machine 1 occurs, for example, in addition to touch panel 14.

Electronic balance 45 detects the weight of liquid medication 5 supplied to prescription bottle 2 and inputs the value of the detected weight to control unit 90. Control unit 90 supplies a predetermined quantity of liquid medication 5 to prescription bottle 2 while receiving weight data of liquid medication 5 in prescription bottle 2 from electronic balance 45. Sensor 85 detects that prescription bottle 2 is at the dispense position and detects adhesion of liquid medication 5 to supply port 36A, and inputs the result of detection to control unit 90.

Liquid medication dispensing machine 1 includes bottle position detecting means 91 that detects the position of each liquid medication bottle 23 in lower space 12 inside housing 6. Bottle position detecting means 91 may be any type of sensor, for example, and the sensor may detect the rotation angle of liquid medication bottle holder 32 around the drum axis line. Liquid medication bottle 23 is rotationally moved around the drum axis line with the rotation of rotation drum 21. Thus, the current position of liquid medication bottle 23 changes frequently. Bottle position detecting means 91 is used to accurately detect the current position of liquid medication bottle 23, and data on the detected current position of liquid medication bottle 23 is input to control unit 90.

Liquid medication dispensing machine 1 also includes a communication unit 92 for making communications with external equipment to receive data from the external equipment. Various parameters related to the operation of liquid medication dispensing machine 1 may be input to control unit 90 by the operation on touch panel 14 described above, or alternatively may be input to control unit 90 from an external computer via communication unit 92.

Liquid medication dispensing machine 1 also includes a memory 93 for control unit 90 to perform calculations. Memory 93 stores data on liquid medication 5 contained in liquid medication bottle 23 mounted on liquid medication dispensing machine 1, data related to the current position of liquid medication bottle 23, and data on the time when previous nozzle cleaning was performed. Liquid medication dispensing machine 1 also includes a recording medium access unit 94 for loading a removable recording medium. The above-described data on liquid medication 5 may be stored in any recording medium loaded in recording medium access unit 94 and may be read appropriately from the recording medium by control unit 90.

Control unit 90 controls liquid medication dispensing machine 1 based on information input from the various types of devices described above. Specifically, control signals are transmitted from control unit 90 to drum rotating motor 22, moving motor 39, pump driving motor 40, stirring motor 52 for stirring liquid medication 5, and elevating device 50. Each motor operates and stops appropriately, so that liquid medication 5 is supplied from liquid medication bottle 23 to prescription bottle 2. Upon termination of supply of liquid medication 5, a piece of paper with a dispensing result printed thereon is output from printers 17*a*, 17*b* constituting an output unit 17. A control signal is transmitted from control unit 90 to fan 73. The fan operates appropriately, so that liquid medication 5 is removed from supply port 36A of supply nozzle 36.

FIG. 18 shows an example of a table showing setting for performing nozzle cleaning. Liquid medication dispensing machine 1 of the present embodiment is capable of optionally setting whether or not to clean supply nozzle 36 at the startup of the machine, at the start of dispensing in accordance with a prescription, and at the completion of dispensing. As shown in FIG. 18, for example, setting can be made to clean supply nozzle 36 at all the opportunities at the startup of the machine, at the start of dispensing, and at the completion of dispensing. An operator, such as a pharmacist, who operates liquid medication dispensing machine 1 is allowed to optionally change settings for performing nozzle cleaning in consideration of the time required for cleaning supply nozzle 36, the frequency of dispensing, and the like. For example, the operator may be allowed to input settings for performing nozzle cleaning to control unit 90 by operating touch panel 14.

FIG. 19 shows an example of a table showing setting of time related to nozzle cleaning. As will be described later in detail, nozzle cleaning is allowed to be performed in liquid medication dispensing machine 1 of the present embodiment at predetermined time intervals during a dispensing stop period when dispensing in accordance with a prescription is not performed. The term "nozzle cleaning inquiry interval" shown in FIG. 19 is a set time T1 until an inquiry whether or not nozzle cleaning is to be performed is made when an operator has selected inexecution of nozzle cleaning in a determination as to whether nozzle cleaning is to be performed after a predetermined time elapses since previous nozzle cleaning at the time of nozzle cleaning during the dispensing stop period. The "nozzle cleaning inquiry interval" is set at 10 minutes, for example. The "nozzle cleaning interval" shown in FIG. 19 refers to a setting of a frequency of nozzle cleaning during the dispensing stop period, and is a setting of time at which interval nozzle cleaning is to be performed. The "nozzle cleaning interval" is a set time T2 selected from a plurality of selectable values, such as 30 minutes, 60 minutes, 90 minutes, for example.

Figure 20:
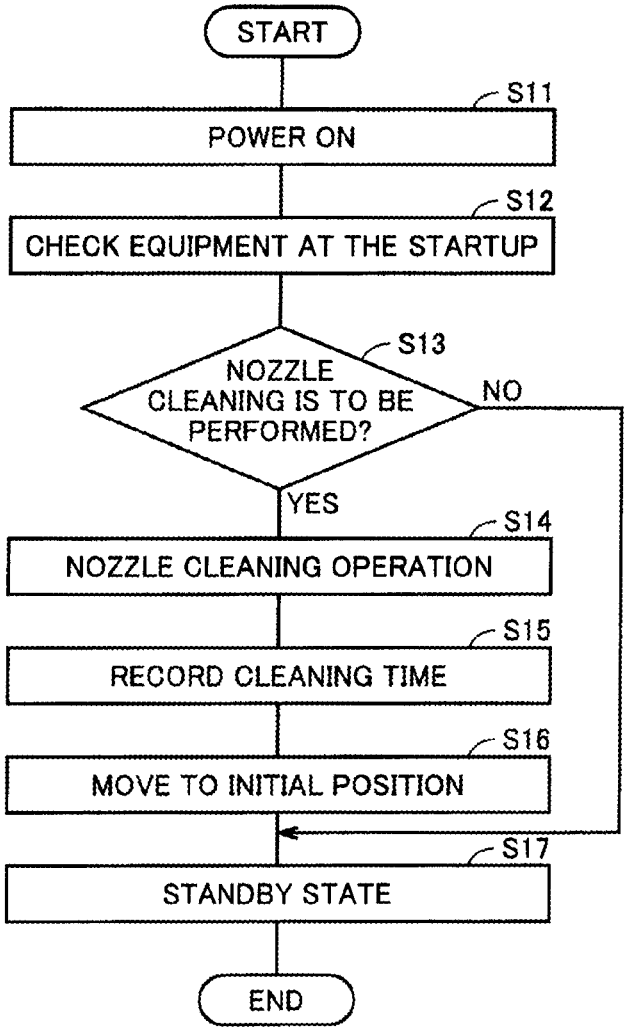
FIG. 20 is a flowchart at the startup of the liquid medication dispensing machine.

FIG. 20 is a flowchart at the startup of liquid medication dispensing machine 1. At the startup of liquid medication dispensing machine 1, when an operator first switches the power source of liquid medication dispensing machine 1 from OFF to ON in step (S11), control unit 90 in step (S12) checks equipment, such as each motor, included in liquid medication dispensing machine 1 at the startup to check that all pieces of equipment are normally operable. Then, it is determined in step (S13) whether or not nozzle cleaning at the startup is to be performed. At this time, control unit 90 refers to the table shown in FIG. 18 to identify whether or not it is a setting that nozzle cleaning at the startup is to be performed.

If it is determined in the determination of step (S13) that it is the setting that nozzle cleaning at the startup is to be performed, nozzle cleaning is performed next in step (S14). Specifically, a control signal is transmitted from control unit 90 to fan 73 and drum rotating motor 22. Fan 73 for supplying air to spray nozzle 71 is activated, and rotation drum 21 is rotated. At this time, rotation drum 21 is rotated, and air jet stream 76 is sprayed from spray nozzle 71 toward all of plurality of supply nozzles 36 included in liquid medication dispensing machine 1. Accordingly, liquid medication 5 adhering to supply ports 36A is removed from supply ports 36A of all supply nozzles 36.

When cleaning of all supply nozzles 36 is completed, then in step (S15), control unit 90 records on memory 93 the time at which cleaning unit 70 is operated and nozzle cleaning is performed. This time is used as a starting point of a time during which nozzle cleaning is not performed, as will be described later in detail. Then in step (S16), control unit 90 issues a further command to drum rotating motor 22 to move rotation drum 21 to an initial position. This initial position is set, for example, such that with rotation drum 21 having moved to the initial position, none of supply nozzles 36 is located at supply position SP and supply position SP lies between two adjacent supply nozzles 36. Alternatively, a position where any of supply nozzles 36 is located at supply position SP may be set as the initial position.

When the movement to the initial position is finished, the process is then advanced to step (S17), and liquid medication dispensing machine 1 is brought into a standby state. In the determination of step (S13), if control unit 90 having referred to the table shown in FIG. 18 identifies that it is the setting that nozzle cleaning at the startup is not to be performed, the process is advanced to step (S17), and liquid medication dispensing machine 1 is brought into the standby state. In this manner, a series of operations at the startup of liquid medication dispensing machine 1 are performed.

Figure 21:
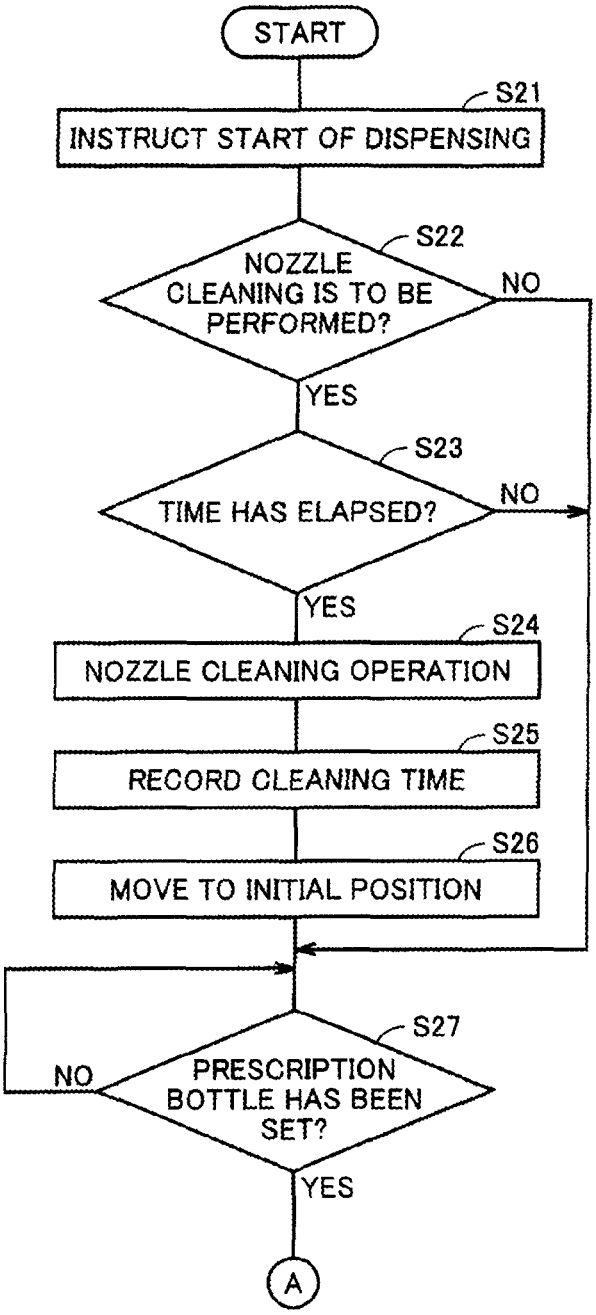
FIG. 21 is a first flowchart showing processing of supplying a liquid medication to a prescription bottle.
Figure 22:
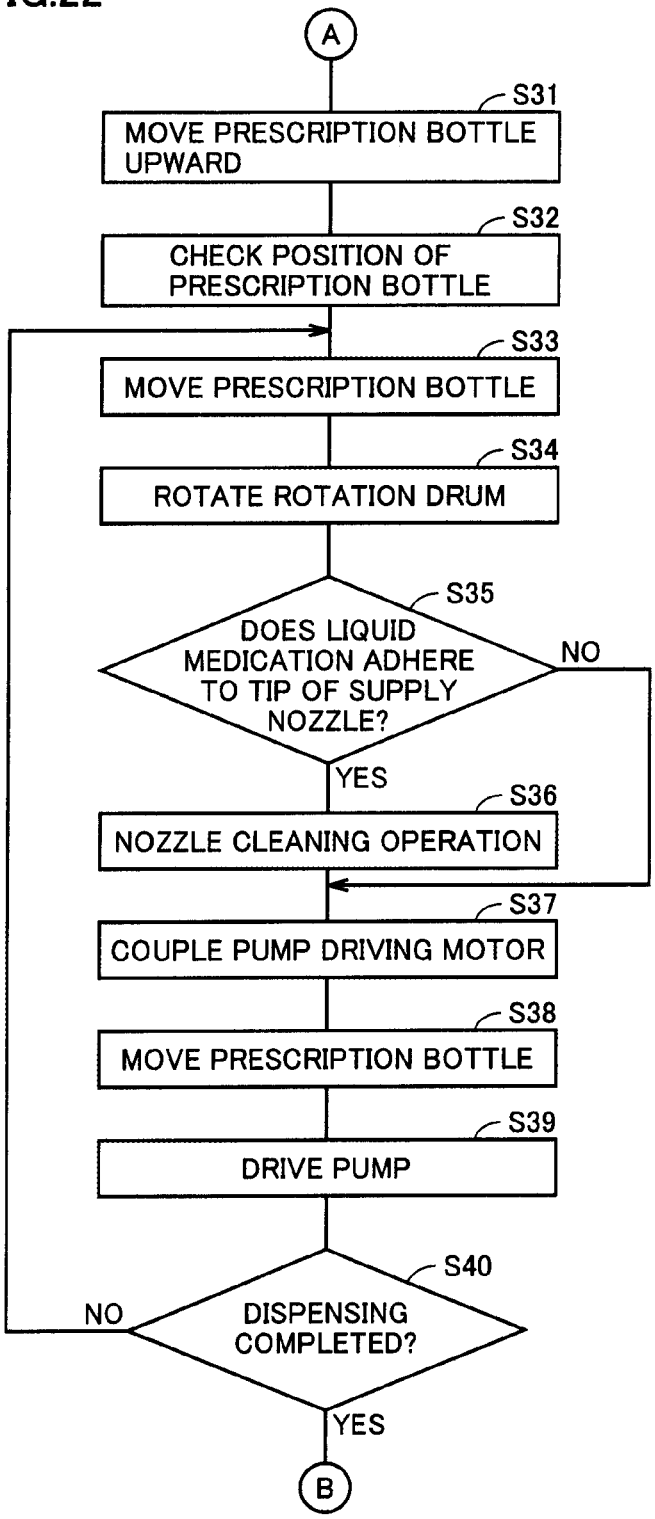
FIG. 22 is a second flowchart showing processing of supplying a liquid medication to a prescription bottle.
Figure 23:
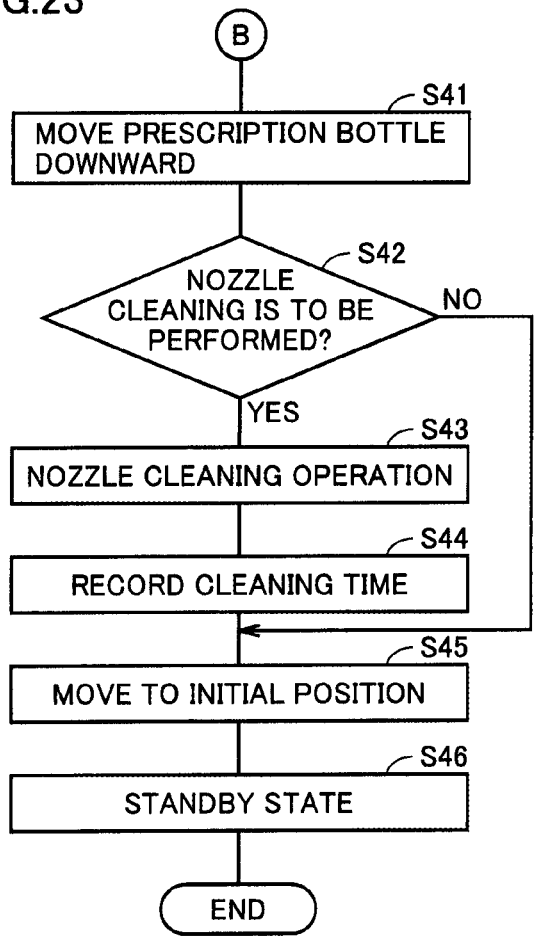
FIG. 23 is a third flowchart showing processing of supplying a liquid medication to a prescription bottle.

FIGS. 21 to 23 are flowcharts showing processing of supplying a liquid medication to prescription bottle 2. When performing dispensing in accordance with a prescription by the processing of supplying a liquid medication from liquid medication bottle 23 to prescription bottle 2 using liquid medication dispensing machine 1 of the present embodiment, the start of dispensing is first instructed in step (S21), and an instruction to start supply of liquid medication 5 to prescription bottle 2 is issued. For example, after liquid medication dispensing machine 1 receives prescription data, dispensing may be started by an operator operating touch panel 14, selecting a prescription, and touching a start button. Alternatively, for example, dispensing may be started as soon as control unit 90 receives a prescription via communication unit 92. When the start of dispensing is instructed, control unit 90 instructs printers 17*a*, 17*b* to print a label to be attached to prescription bottle 2, with the patient's name, pharmacy name, medication time, dose, and the like printed thereon.

Next, it is determined in step (S22) whether or not nozzle cleaning at the start of dispensing is to be performed. Control unit 90 refers to the table shown in FIG. 18 to identify whether or not it is the setting that nozzle cleaning at the start of dispensing is to be performed.

If it is determined in the determination of step (S22) that it is the setting that nozzle cleaning at the start of dispensing is to be performed, then, it is determined in step (S23) whether or not a predetermined time has elapsed so far since previous nozzle cleaning. Control unit 90 calculates the time elapsed so far since previous nozzle cleaning based on the time of previous nozzle cleaning recorded on memory 93 and the present time. Control unit 90 further compares the calculated time with the predetermined time set as the nozzle cleaning interval which is a threshold value to determine whether the predetermined time has already elapsed since previous nozzle cleaning or it has not yet elapsed.

It takes a certain amount of time until an amount of liquid medication 5 that may drop down from supply port 36A of supply nozzle 36 is gathered at supply port 36A after completion of nozzle cleaning. If dispensing is started without any delay after the completion of previous nozzle cleaning, it is considered that the amount of liquid medication 5 gathered at supply port 36A of supply nozzle 36 is a sufficiently small amount to such an extent that liquid dropping from supply port 36A will not occur.

In this case, even if nozzle cleaning is not performed at the start of dispensing, liquid dropping from supply nozzle 36 is unlikely to occur, and there is sufficiently little influence that liquid medication 5 adhering to supply port 36A would result in an error of the amount of supply of liquid medication 5 to prescription bottle 2. Therefore, if the predetermined time has not elapsed since previous nozzle cleaning, nozzle cleaning at the start of dispensing can be omitted. Accordingly, the time required for nozzle cleaning at the start of dispensing can be shortened. Thus, the time required for dispensing can be shortened further.

When it is determined in step (S23) that the predetermined time has already elapsed so far since previous nozzle cleaning, nozzle cleaning is then performed in step (S24), and liquid medication 5 adhering to supply ports 36A is removed from supply ports 36A of all supply nozzles 36. By operating cleaning unit 70 at the start of dispensing, liquid medication 5 left alone at supply port 36A for a long time to be solidified can be removed from supply port 36A. Therefore, stable supply of the liquid medication to prescription bottle 2 is achieved, and dispensing can be improved in accuracy. Moreover, liquid dropping from supply nozzle 36 passing above upper opening 2A of prescription bottle 2 into prescription bottle 2 can be prevented.

When cleaning of all supply nozzles 36 is completed, then, in step (S25), the time at which nozzle cleaning is performed is recorded on memory 93. Thereafter, in step (S26), rotation drum 21 is moved to the initial position.

Then, it is determined in step (S27) whether prescription bottle 2 has been set. It is noted that if it is determined in step (S22) that nozzle cleaning is not to be performed, and if it is determined in step (S23) that the predetermined time has not elapsed, the determination of step (S27) is performed immediately.

In step (S27), it is determined whether or not prescription bottle 2 is being held by prescription bottle holder 47 described with reference to FIGS. 1 to 5. A display that prompts an operator to set prescription bottle 2 is made on touch panel 14. Upon setting prescription bottle 2 on table 48 at the mount/dismount position for placing prescription bottle 2 on table 48 and causing prescription bottle holder 47 to hold prescription bottle 2, the operator operates a button on touch panel 14 that instructs completion of setting of prescription bottle 2. When the completion button for setting of prescription bottle 2 is operated, it is determined that the prescription bottle is held by prescription bottle holder 47, and the process is advanced to step (S31) through a connector A.

It is noted that, to reliably prevent liquid medication 5 removed from supply nozzle 36 during nozzle cleaning in step (S24) from being mixed into prescription bottle 2, it is more preferable to set prescription bottle 2 after the completion of nozzle cleaning in step (S24) than to previously set prescription bottle 2 on table 48 and then start dispensing.

In step (S31), control unit 90 transmits a control signal to elevating device 50, and elevating device 50 moves weight detection unit 4 upward. Thus, prescription bottle 2 is moved up from the mount/dismount position to the dispense position. Weight detection unit 4 is moved upward until it reaches the dispense position where liquid medication 5 can be supplied from supply nozzle 36 to prescription bottle 2. When prescription bottle 2 reaches the dispense position, then in step (S32), the position of prescription bottle 2 in the vertical direction is checked. When upper opening 2A of prescription bottle 2 reaches a prescribed position, the position of prescription bottle 2 is detected by sensor 85 shown in FIG. 12. Control unit 90 receives a signal indicating the position of prescription bottle 2 from sensor 85, and checks the position of prescription bottle 2.

Next, in step (S33), prescription bottle 2 is moved to a position that does not interfere with the rotation of rotation drum 21. Specifically, a control signal is sent from control unit 90 to elevating device 50, and when elevating device 50 is moved downward to some extent, prescription bottle 2 is also moved downward. It is noted that the moving direction of prescription bottle 2 is not limited to the vertical direction, but may be a direction away from rotation drum 21, for example.

After the movement of prescription bottle 2, then in step (S34), drum rotating motor 22 is controlled, and rotation drum 21 is rotated. Control unit 90 transmits a control signal to drum rotating motor 22, so that driving force of drum rotating motor 22 is transmitted to rotation drum 21. When liquid medication bottle 23 is mounted on liquid medication bottle holder 32 attached to rotation drum 21 and drum rotating motor 22 is driven, rotation drum 21 is rotated to move liquid medication bottle 23 horizontally.

With the rotation of rotation drum 21, liquid medication bottle 23 containing therein liquid medication 5 or a diluent to be supplied next to prescription bottle 2 and supply port 36A of supply nozzle 36 are located at the forefront side of liquid medication dispensing machine 1. With the rotation of rotation drum 21, supply pipe 60 corresponding to liquid medication 5 to be supplied to prescription bottle 2 is moved horizontally in the drum circumferential direction until it reaches the position where supply port 36A of supply nozzle 36 faces upper opening 2A of prescription bottle 2. By locating liquid medication bottle 23 at the forefront side of the machine, the operator dispensing liquid medication 5 can visually identify the type of liquid medication 5 to be dispensed from the front side of liquid medication dispensing machine 1.

Upon completion of the rotation of rotation drum 21, then in step (S35), it is determined whether or not liquid medication 5 adheres to supply port 36A at the tip of supply nozzle 36 located at supply position SP facing upper opening 2A of prescription bottle 2. Sensor 85 described above is used to detect adhesion of liquid medication 5 to supply port 36A. In the determination of step (S35), if sensor 85 detects adhesion of liquid medication 5 to supply nozzle 36 and if it is determined that liquid medication 5 adheres to supply port 36A, nozzle cleaning is then performed in step (S36). Specifically, a control signal is transmitted from control unit 90 to fan 73 and drum rotating motor 22. Thereby, fan 73 for supplying air to spray nozzle 71 is started, and rotation drum 21 is rotated to move supply nozzle 36 to cleaning position CP.

In this case, air jet stream 76 is sprayed from spray nozzle 71 to one supply nozzle 36 determined that liquid medication 5 adheres to its supply port 36A. With the rotation of rotation drum 21, the one supply nozzle 36 determined that liquid medication 5 adheres to its supply port 36A is moved to cleaning position CP. Accordingly, liquid medication 5 adhering to supply port 36A is removed from supply port 36A of the one supply nozzle 36. After removal of liquid medication 5 from supply port 36A is performed for a predetermined time, fan 73 is stopped. Thereafter, rotation drum 21 is rotated in the reverse direction, so that supply nozzle 36 having been cleaned is moved again to supply position SP.

If it is determined in the determination of step (S35) that liquid medication 5 does not adhere to supply port 36A, nozzle cleaning in step (S36) is not performed, but the process is directly advanced to step (S37). It is noted that steps (S35), (S36) may be omitted as appropriate. Moreover, if it is determined in the determination of step (S35) that liquid medication 5 adheres to supply port 36A, a display that prompts the operator to manually clean supply port 36A to which liquid medication 5 adheres may be made on touch panel 14.

Next, in step (S37), pump driving motor 40 is moved forward to couple coupling member 42 of pump driving motor 40 to coupled member 44 of pump 24. This brings a state in which the rotation of pump driving motor 40 can be transmitted to pump 24, that is, a state in which pump 24 can be driven.

Next, in step (S38), prescription bottle 2 moved in step (S33) is moved again to the dispense position. A control signal is sent from control unit 90 to elevating device 50, and elevating device 50 is moved upward again. Thus, prescription bottle 2 is also moved upward. Accordingly, prescription bottle 2 is located at the dispense position where liquid medication 5 can be supplied from supply nozzle 36 to prescription bottle 2.

Then, in step (S39), control unit 90 transmits a control signal to pump driving motor 40, and selectively drives pump 24 corresponding to selected liquid medication bottle 23 with pump driving unit 25. With the driving of pump 24, a predetermined amount of liquid medication 5 in liquid medication bottle 23 defined by a prescription is supplied from liquid medication bottle 23 to prescription bottle 2 via supply pipe 60. Control unit 90 receives weight data on liquid medication 5 in prescription bottle 2 from electronic balance 45, and checks the amount of liquid medication 5 supplied to prescription bottle 2. When predetermined amount of liquid medication 5 is supplied to prescription bottle 2, dispensing of first liquid medication 5 to prescription bottle 2 is terminated.

By rotating pump 24 in the reverse direction after the termination of supply of liquid medication 5 to prescription bottle 2, liquid medication 5 flows back from first portion 61 to second portion 62 of supply pipe 60, so that liquid medication 5 remaining in first portion 61 is moved to second portion 62. The amount of liquid medication 5 present in first portion 61 is thereby reduced, which can further prevent liquid medication 5 in first portion 61 from being moved to supply port 36A with gravity. At this time, if supply port 36A of supply nozzle 36 is sealed so that the internal space of supply nozzle 36 can be decompressed, the residual amount of liquid medication 5 in first portion 61 can be reduced more efficiently.

Then, it is determined in step (S40) whether or not supply of liquid medication 5 (and a diluent when necessary) to prescription bottle 2 in accordance with a prescription has been fully completed and dispensing has been completed. If supply of liquid medication 5 has not been completed, the process is returned to step (S33), where rotation drum 21 is rotated such that liquid medication bottle 23 containing liquid medication 5 to be supplied next and supply port 36A of supply nozzle 36 are located at the forefront side of the machine, and subsequent liquid medication 5 or a diluent is supplied to prescription bottle 2. If it is determined that supply of all liquid medications 5 has been completed and dispensing has been completed, the process is advanced to step (S41) through a connector B, where elevating device 50 moves table 48 downward, thereby moving prescription bottle 2 downward. A control signal is transmitted from control unit 90 to elevating device 50, and when elevating device 50 moves table 48 downward, prescription bottle 2 is moved downward. Table 48 is moved downward until it returns to the mount/dismount position from the dispense position.

Next, it is determined in step (S42) whether or not nozzle cleaning at the completion of dispensing is to be performed. Control unit 90 refers to the table shown in FIG. 18 to identify whether or not it is the setting that nozzle cleaning at the completion of dispensing is to be performed.

If it is determined in the determination of step (S42) that it is the setting that nozzle cleaning at the completion of dispensing is to be performed, then in step (S43), nozzle cleaning is performed, so that liquid medication 5 adhering to supply ports 36A is removed from supply ports 36A of all supply nozzles 36. By operating cleaning unit 70 at the completion of dispensing to remove liquid medication 5 from supply port 36A, liquid dropping from supply nozzle 36 through which liquid medication 5 has passed along with dispensing can be prevented, so that occurrence of liquid dropping into liquid medication dispensing machine 1 can be prevented.

Upon completion of cleaning of all supply nozzles 36, then in step (S44), the time at which nozzle cleaning is performed is recorded on memory 93. Thereafter, in step (S45), rotation drum 21 is moved to the initial position. If it is determined in the determination of step (S42) that it is the setting that nozzle cleaning at the completion of dispensing is not to be performed, the movement of rotation drum 21 in step (S45) is performed immediately. Thereafter, the process is advanced to step (S46), where liquid medication dispensing machine 1 is brought into the standby state. In this manner, dispensing with liquid medication dispensing machine 1 of the present embodiment is completed.

Figure 24:
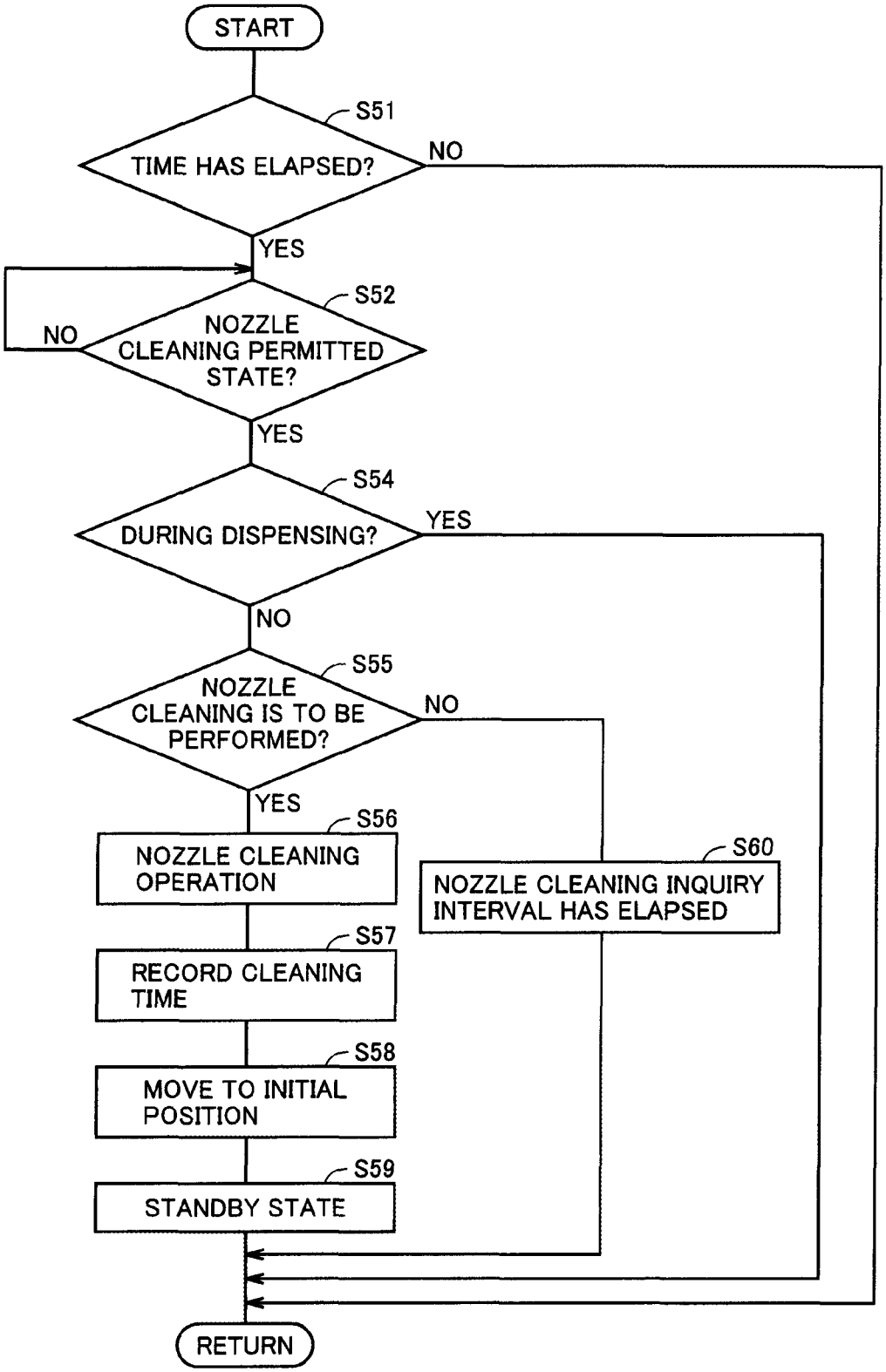
FIG. 24 is a flowchart of nozzle cleaning during a dispensing stop period.

FIG. 24 is a flowchart of nozzle cleaning during the dispensing stop period. FIG. 24 illustrates a flow when operating cleaning unit 70 at predetermined time intervals and performing nozzle cleaning in order to remove liquid medication 5 gathered at supply port 36A with the lapse of time during the dispensing stop period while dispensing in accordance with a prescription is not performed from supply port 36A to prevent liquid dropping. As shown in FIG. 24, first in step (S51), a determination similar to the determination in step (S23) described above is made as to whether or not a predetermined time has elapsed so far since previous nozzle cleaning.

This predetermined time may be set in correspondence to the types of liquid medications 5 contained in plurality of liquid medication bottles 23. The time until liquid dropping from supply nozzle 36 occurs varies depending on the type of liquid medication 5. For example, liquid medication 5 having low viscosity or liquid medication 5 having a high specific gravity value drops down for a shorter time. Therefore, the predetermined time can be set in correspondence to a plurality of types liquid medications 5 contained in liquid medication bottles 23. For example, in correspondence to liquid medication 5 that causes liquid dropping in the shortest time, a time in which liquid medication 5 that causes liquid dropping in the shortest time will not drop down may be set. Moreover, since the time until liquid dropping from supply nozzle 36 occurs also varies depending on the surrounding environmental conditions, such as temperature, humidity and temperature changes. Therefore, when the surrounding environmental conditions vary, the predetermined time may be changed in correspondence to the variation.

If it is determined in the determination of step (S51) that the predetermined time has elapsed since previous nozzle cleaning, then, it is determined in step (S52) whether or not liquid medication dispensing machine 1 is in a state that may permit nozzle cleaning. It is considered that nozzle cleaning attended with rotation of rotation drum 21 cannot be performed depending on the current state of liquid medication dispensing machine 1. Examples of the case where nozzle cleaning cannot be performed include a case where an operator who operates liquid medication dispensing machine 1 is performing maintenance of liquid medication dispensing machine 1, such as cleanup of the inside of housing 6, a case where liquid medication bottles 23 are being exchanged, and a case where front cover portion 18 is in an open state.

If liquid medication dispensing machine 1 is in a setting state that may not permit nozzle cleaning, the determination in step (S52) is performed repeatedly again.

If it is determined in the determination of step (S52) that liquid medication dispensing machine 1 is in the state that may permit nozzle cleaning, then in step (S54), a determination is made as to whether or not dispensing is being performed. Since nozzle cleaning cannot be performed during dispensing, it is necessary for performing nozzle cleaning that dispensing is not being performed. If it is determined in the determination of step (S54) that dispensing is not being performed, then in step (S55), it is determined whether or not nozzle cleaning is to be performed.

In step (S55), the operator who operates liquid medication dispensing machine 1 selects whether or not nozzle cleaning is to be performed. For example, execution or inexecution of nozzle cleaning may be selected by displaying a screen that allows the operator to select execution or inexecution of nozzle cleaning on touch panel 14 and the operator touching a predetermined region on the screen.

If execution of nozzle cleaning is selected in step (S55), then in step (S56), nozzle cleaning is performed. At this time, nozzle cleaning may be performed on all supply nozzles 36. Alternatively, supply nozzles 36 may be moved sequentially to supply position SP, adhesion of liquid medication 5 to supply ports 36A may be detected using sensor 85 at supply position SP, and nozzle cleaning may be performed only for supply nozzle 36 having supply port 36A to which liquid medication 5 adheres. Still alternatively, another sensor different from sensor 85 may be located at cleaning position CP, supply nozzles 36 may be moved sequentially to cleaning position CP, and adhesion of liquid medication 5 to supply ports 36A may be detected using the other different sensor at cleaning position CP, and nozzle cleaning may be performed only for supply nozzle 36 having supply port 36A to which liquid medication 5 adheres.

Upon completion of cleaning of supply nozzle 36, then in step (S57), the time at which nozzle cleaning is performed is recorded on memory 93. Thereafter, in step (S58), rotation drum 21 is moved to the initial position, then the process is advanced to step (S59), where liquid medication dispensing machine 1 is brought into the standby state.

If inexecution of nozzle cleaning is selected in step (S55), control unit 90 refers to the table shown in FIG. 19 to recognize the nozzle cleaning inquiry interval. Thereafter, the process is advanced to step (S60), where after the time set as the nozzle cleaning inquiry interval elapses, the control flow is returned. If it is determined in the determination of step (S51) that the predetermined time has not elapsed since previous nozzle cleaning, and also if it is determined in the determination of step (S54) that dispensing is being performed, the control flow is returned. If the control flow shown in FIG. 24 is returned, the process is returned again to step (S51), where the flow for performing nozzle cleaning at predetermined time intervals during the dispensing stop period is continued.

The time at which nozzle cleaning is performed serves as a starting point of lapse of the predetermined time since previous nozzle cleaning. In steps (S15), (S25), (S44), and (S57) described above, the time at which nozzle cleaning is performed is recorded on memory 93 each time. In the determination of step (S51), if the predetermined time has elapsed, nozzle cleaning may be performed, but if the predetermined time has not elapsed, it is not necessary to perform nozzle cleaning.

By recording the time at which nozzle cleaning is performed each time, control unit 90 calculates the time from previous nozzle cleaning to the present based on the time of previous nozzle cleaning recorded on memory 93 and the present time. Control unit 90 further compares the calculated time with the predetermined time set as the nozzle cleaning interval which is a threshold value, and it is determined whether the predetermined time has already elapsed since previous nozzle cleaning or whether it has not yet elapsed. Therefore, a problem in that nozzle cleaning is not performed for a long time and liquid medication 5 drops down from supply port 36A can be prevented from occurring with higher reliability.

Setting of the time serving as an end point of the predetermined time indicating that the predetermined time has elapsed since previous nozzle cleaning may be updated each time when nozzle cleaning is performed, and setting of the next time when cleaning unit 70 is to be operated and nozzle cleaning is to be performed may be updated. Alternatively, when nozzle cleaning is performed, control unit 90 may register in a timer the predetermined time set as the nozzle cleaning interval which is a threshold value to determine whether the predetermined time registered in the timer has been elapsed since the time of previous nozzle cleaning or whether it has not yet elapsed.

It is noted that, in the above description, supply pipe 60 is formed of tube 34, elbow member 65 and supply nozzle 36, but it is not limited to this example. Instead of elbow member 65, tube 34 and supply nozzle 36 may be coupled to each other with a curved elbow joint. Alternatively, elbow member 65 is not indispensable if supply pipe 60 can be arranged such that, in proximity to an end of supply pipe 60 on the prescription bottle 2 side, the flow of liquid medication 5 toward that end is moved upward, then downward, and is flown out of the end into prescription bottle 2. That is, the flow direction of liquid medication 5 can also be defined by arranging tube 34 upon curving or bending. Furthermore, supply nozzle 36 may also be omitted, and supply pipe 60 may be formed of one tube 34.

Moreover, although the example in which plurality of supply pipes 60 are rotationally moved in the drum circumferential direction with the rotation of rotation drum 21 has been described, for example, a structure that reciprocally moves plurality of supply pipes 60 may be provided additionally, and supply nozzles 36 reciprocally moving may be sequentially located at supply position SP. Supply pipe 60 may be moved relative to prescription bottle 2 in any way as long as supply ports 36A of plurality of supply nozzles 36 can be moved sequentially to a position facing upper opening 2A above upper opening 2A of prescription bottle 2.

Alternatively, as will be described later in detail, it may be structured such that the operation of fan 73 is continued while dispensing is being performed to rotate nozzle attachment plate 53 in the clockwise and counterclockwise directions. In this case, supply nozzle 36 is moved clockwise to adjacent position AP, cleaning position CP and supply position SP in the order presented, and liquid medication 5 is supplied to prescription bottle 2 at supply position SP. Then, the rotation direction of nozzle attachment plate 53 is switched. Thereafter, supply nozzle 36 is moved to cleaning position CP counterclockwise. After liquid medication 5 is removed from supply port 36A at cleaning position CP, the rotation direction of nozzle attachment plate 53 is switched again. Supply nozzle 36 corresponding to liquid medication 5 to be supplied next is moved similarly to above-described supply nozzle 36.

Then, liquid dropping from supply nozzle 36 passing above upper opening 2A can be prevented, and contamination in which liquid medication 5 of a type that is not planned to be supplied to prescription bottle 2 is mixed into prescription bottle 2 can be prevented from occurring. Furthermore, by cleaning supply port 36A immediately after liquid medication 5 is supplied to prescription bottle 2, liquid medication dispensing machine 1 can be prevented from getting dirty due to liquid dropping of liquid medication 5 into liquid medication dispensing machine 1, and occurrence of contamination can be prevented with higher reliability.

Second Embodiment

Figure 25:
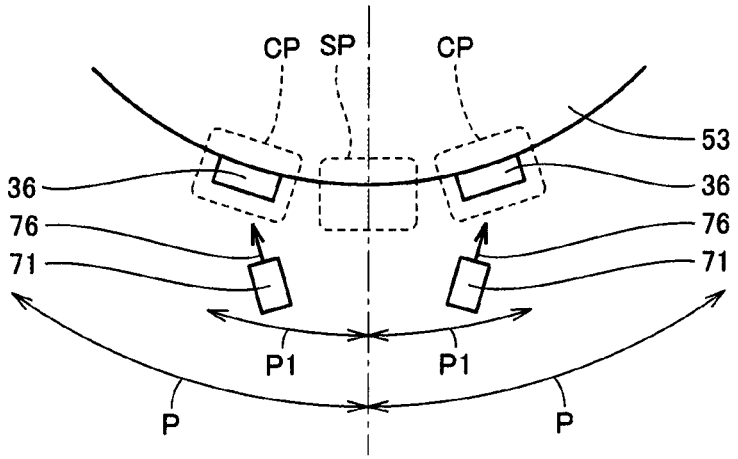
FIG. 25 is a schematic view showing the positional relationship between the supply position and the cleaning position in a liquid medication dispensing machine of a second embodiment.

FIG. 25 is a schematic view showing the positional relationship between supply position SP and cleaning position CP in liquid medication dispensing machine 1 of the second embodiment. Liquid medication dispensing machine 1 of the second embodiment differs from that of the first embodiment by including a plurality of cleaning units 70.

Cleaning units 70 of the second embodiment are provided such that liquid medication 5 can be removed from supply ports 36A of supply nozzles 36 at plurality of cleaning positions CP. Plurality of cleaning positions CP are provided at positions away from supply position SP to the opposite sides by distance P1 smaller than spacing P between supply ports 36A of supply nozzles 36.

As shown in FIG. 25, spray nozzles 71 of cleaning units 70 are located at positions away from supply position SP to the opposite sides in the drum circumferential direction in which supply nozzles 36 are moved. A pair of cleaning positions CP are provided between supply position SP and adjacent positions AP on the opposite sides (see FIG. 15). At cleaning position CP, air jet stream 76 is sprayed onto supply port 36A of supply nozzle 36 from spray nozzle 71, so that liquid medication 5 adhering to supply port 36A is removed from supply port 36A.

Cleaning positions CP are provided to the opposite sides of supply position SP in the moving direction of supply nozzle 36, and distance P1 between supply position SP and cleaning position CP is smaller than spacing P between supply position SP and supply nozzle 36.

Therefore, whichever direction, clockwise or counterclockwise, supply nozzle 36 is moved with the rotation of rotation drum 21, after removing liquid medication 5 from supply port 36A at either cleaning position CP, supply nozzle 36 is moved to supply position SP, so that supply port 36A can be cleaned immediately before supply of liquid medication 5 to prescription bottle 2. Whichever direction, clockwise or counterclockwise, supply nozzle 36 is moved with the rotation of rotation drum 21, supply nozzle 36 having supplied liquid medication 5 to prescription bottle 2 at supply position SP is moved from supply position SP to either cleaning position CP, so that supply port 36A can be cleaned immediately after supply of liquid medication 5 to prescription bottle 2.

Spray nozzles 71 of cleaning units 70 are located such that two supply nozzles 36 at their initial positions are located simultaneously at cleaning positions CP on the both left and right sides and liquid medication 5 can be removed from two supply nozzles 36 simultaneously. Cleaning units 70 are located such that supply nozzle 36 moving away from supply position SP after supplying liquid medication 5 to prescription bottle 2 and supply nozzle 36 approaching supply position SP can be cleaned simultaneously. A pair of spray nozzles 71 are provided at line symmetric positions with respect to a straight line, indicated by an alternate long and short dash line in FIG. 25, passing through the drum axis line and through supply position SP, and eject air in the direction forming an identical angle with that straight line. Two arrows indicating air jet stream 76 in FIG. 25 form an identical angle with the alternate long and short dash line in FIG. 25.

Cleaning unit 70 of the second embodiment may have two sets of cleaning units 70 structured as having been described with reference to FIG. 13. Alternatively, cleaning unit 70 of the second embodiment may be structured to have a branch pipe branched from airflow pipe 74 shown in FIG. 13 on the way and to supply air from a single fan 73 to both of pair of spray nozzles 71.

Liquid medication dispensing machine 1 of the second embodiment may operate similarly to liquid medication dispensing machine 1 of the first embodiment described with reference to FIGS. 20 to 24.

Figure 26:
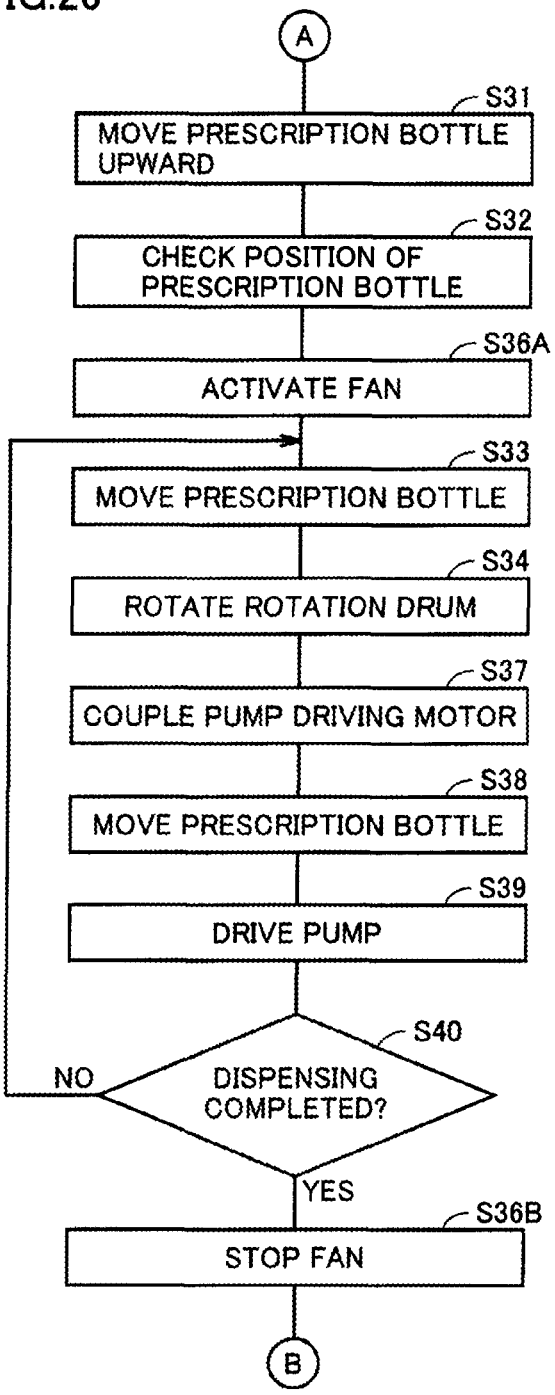
FIG. 26 is a flowchart showing a part of a variation of processing of supplying a liquid medication to a prescription bottle.

FIG. 26 is a flowchart showing a part of a variation of processing of supplying a liquid medication to prescription bottle 2 according to the first or second embodiment. The flow shown in FIG. 26 is equivalent to the flow from connector A through connector B shown in FIG. 22 in the processing of supplying a liquid medication described with reference to FIGS. 21 to 23.

In the flow of the variation shown in FIG. 26, before the supply of liquid medication 5 to prescription bottle 2 is started, control unit 90 in step (S36A) transmits a control signal to fan 73, and fan 73 is activated. While dispensing is performed in steps (S33) to (S40), the operation of fan 73 is continued. After the completion of dispensing, control unit 90 in step (S36B) transmits a control signal to fan 73, and fan 73 is stopped.

Then, when rotation drum 21 is rotated during dispensing, all supply nozzles 36 being moved to supply position SP can be cleaned. Thus, liquid medication 5 can reliably be removed from supply port 36A of supply nozzle 36 passing above supply position SP. Therefore, contamination during dispensing can be prevented with higher reliability. At the same time, since all supply nozzles 36 moved from supply position SP can be cleaned, liquid medication 5 can reliably be removed from supply nozzle 36 immediately after supplying liquid medication 5 to prescription bottle 2. Therefore, liquid dropping of liquid medication 5 into liquid medication dispensing machine 1 can be prevented with higher reliability.

When dispensing is performed in accordance with a prescription including a plurality of types of liquid medications, a structure that can clean all supply nozzles 36 that pass by supply position SP with the rotation of rotation drum 21 can prevent contamination with even higher reliability, which is desirable. That is, after supplying the first liquid medication to prescription bottle 2, and when moving supply nozzle 36 corresponding to a second liquid medication to supply position SP, supply nozzle 36 corresponding to the first liquid medication can be cleaned. When moving supply nozzle 36 corresponding to a third liquid medication to supply position SP after supplying the second liquid medication to prescription bottle 2, supply nozzle 36 corresponding to the second liquid medication, or both supply nozzle 36 corresponding to first liquid medication 5 and supply nozzle 36 corresponding to second liquid medication 5 can be cleaned. Therefore, supply nozzle 36 where contamination is most likely to occur immediately after liquid medication 5 flows therethrough can be cleaned reliably. Thus, contamination can be prevented from occurring with even higher reliability.

It is noted that although the operation of fan 73 is continued in steps (S33) to (S40) in the flowchart of the variation shown in FIG. 26, fan 73 may be activated and operated only when the rotation drum in step (S34) is rotated.

Although the embodiments of the present invention have been described above, it should be understood that the embodiments disclosed herein are illustrative and non-restrictive in every respect. The scope of the present invention is defined by the claims not by the description above, and is intended to include any modification within the meaning and scope equivalent to the terms of the claims.

REFERENCE SIGNS LIST

1 liquid medication dispensing machine; 2 prescription bottle; 2A upper opening; 5 liquid medication; 21 rotation drum; 23 liquid medication bottle; 34 tube; 36 supply nozzle; 36A supply port; 60 supply pipe; 70 cleaning unit; 71 spray nozzle; 72 blow hole; 73 fan; 74 airflow pipe; 76 air jet stream; 78 droplet; 85 sensor; 90 control unit; CP cleaning position; SP supply position.

The invention claimed is:

1. A liquid medication dispensing machine selectively supplying a plurality of different types of liquid medications from a plurality of liquid medication bottles containing said liquid medications, respectively, to a prescription bottle, comprising:

a plurality of supply pipes through which said liquid medication flows from each of the plurality of said liquid medication bottles toward said prescription bottle; and a supply pipe moving unit that relatively moves said supply pipes with respect to said prescription bottle, said supply pipes each including one end at which said liquid medication flows toward said prescription bottle, a plurality of said one ends being arranged at regular intervals, said supply pipe moving unit sequentially moving the plurality of said supply pipes to a supply position where said one end faces an upper opening of said prescription bottle above the upper opening, said liquid medication dispensing machine further comprising a cleaning unit that removes said liquid medication adhering to said one end from said one end, said supply pipe moving unit sequentially moving the plurality of said supply pipes to a cleaning position where said cleaning unit removes said liquid medication from said one end, and said cleaning position being provided at a position away from said supply position by a distance smaller than a spacing between said one ends.

2. The liquid medication dispensing machine according to claim 1, comprising a sensor that detects adhesion of said liquid medication to said one end, wherein when said sensor detects adhesion of said liquid medication to said one end, said supply pipe moving unit moves said supply pipe to said cleaning position.

3. The liquid medication dispensing machine according to claim 2, wherein said sensor is a sensor that detects the position of said prescription bottle.

4. The liquid medication dispensing machine according to claim 1, wherein said cleaning unit can remove said liquid medication from said one end at a plurality of said cleaning positions, and said cleaning positions are provided respectively at positions away from said supply position to opposite sides from said supply position by a distance smaller than the spacing between said one ends.

5. The liquid medication dispensing machine according to claim 1, wherein said cleaning positions are provided at positions away from said supply position by a half distance of the spacing between said one ends.

6. The liquid medication dispensing machine according to claim 1, wherein said supply pipe moving unit moves said supply pipes to said cleaning position at a predetermined time interval during a dispensing stop period during which dispensing of supplying said liquid medication from said liquid medication bottle to said prescription bottle in accordance with a prescription is not performed.

7. The liquid medication dispensing machine according to claim 6, wherein said predetermined time interval is set in correspondence to the type of said liquid medication contained in said liquid medication bottle.

8. The liquid medication dispensing machine according to claim 1, wherein said supply pipes each have a first portion including said one end located to face said upper opening of said prescription bottle and a second portion coupled to said first portion, said liquid medication supplied to said prescription bottle flows out of said supply pipe via said one end, said second portion forms an upflow of said liquid medication toward said first portion, and said first portion forms a downflow of said liquid medication leading to said one end.

9. The liquid medication dispensing machine according to claim 8, wherein said first portion includes a first arm portion, said second portion includes a second arm portion, said first arm portion and said second arm portion are coupled with a coupling portion located above said first arm portion and said second arm portion, and said second arm portion forms an upflow of said liquid medication toward said coupling portion, and said first arm portion forms the downflow of said liquid medication leading to said one end.

10. The liquid medication dispensing machine according to claim 8, wherein said supply pipes each include a bent member, said bent member has a first arm portion, a second arm portion, and a coupling portion that couples said first arm portion and said second arm portion, said coupling portion is located above said first arm portion and said second arm portion, said first portion includes said first arm portion, and said second portion includes said second arm portion.

11. The liquid medication dispensing machine according to claim 8, comprising a pump that transports said liquid medication from each of the plurality of said liquid medication bottles to said prescription bottle, wherein said pump causes said liquid medication to flow backward from said first portion to said second portion after supply of said liquid medication to said prescription bottle is terminated.

12. A liquid medication dispensing machine according to claim 8, wherein, said cleaning unit includes an air injection unit that sprays air onto said one end.

* * * * *